US008899713B2

(12) United States Patent
Ishimoto et al.

(10) Patent No.: US 8,899,713 B2
(45) **Date of Patent: *Dec. 2, 2014**

(54) LIQUID EJECTING APPARATUS AND LIQUID EJECTING METHOD

(71) Applicant: Seiko Epson Corporation, Tokyo (JP)

(72) Inventors: Bunji Ishimoto, Matsumoto (JP); Yumiko Takeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/622,068

(22) Filed: Sep. 18, 2012

(65) Prior Publication Data

US 2013/0016160 A1 Jan. 17, 2013

Related U.S. Application Data

(62) Division of application No. 12/814,854, filed on Jun. 14, 2010, now Pat. No. 8,292,391.

(30) Foreign Application Priority Data

Jul. 28, 2009 (JP) ..... 2009-175736

(51) Int. Cl.
*B41J 29/38* (2006.01)
*B41J 2/21* (2006.01)

(52) U.S. Cl.
CPC ..... *B41J 2/2114* (2013.01)
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 6,102,537 | A | 8/2000 | Kato et al. | |
| 6,158,835 | A * | 12/2000 | Jackson et al. | 347/12 |
| 6,267,476 | B1 | 7/2001 | Kato et al. | |
| 6,511,144 | B2 | 1/2003 | Otsuki | |
| 6,655,797 | B2 | 12/2003 | Smith et al. | |
| 6,789,867 | B2 | 9/2004 | Takahashi et al. | |

(Continued)

FOREIGN PATENT DOCUMENTS

| | | | |
|---|---|---|---|
| JP | 2000-025210 | A | 1/2000 |
| JP | 2002-038063 | A | 2/2002 |

(Continued)

*Primary Examiner* — Alessandro Amari
*Assistant Examiner* — Jeremy Bishop
(74) *Attorney, Agent, or Firm* — Nutter McClennen & Fish LLP; John J. Penny, Jr.; Michael P. Visconti, III

(57) ABSTRACT

A liquid ejecting apparatus includes: a first nozzle row in which first nozzles ejecting a first liquid are arranged in a predetermined direction; a second nozzle row in which second nozzles ejecting a second liquid are arranged in the predetermined direction; a movement mechanism moving the first and second nozzle rows in a movement direction intersecting the predetermined direction relative to a medium; a transport mechanism transporting the medium in the predetermined direction relative to the first and second nozzle rows; and a control unit repeating an image forming operation of ejecting the liquids from the first and second nozzles while moving the first and second nozzle rows in the movement direction by the movement mechanism and a transport operation of transporting the medium in the predetermined direction relative to the first and second nozzle rows by the transport mechanism.

6 Claims, 13 Drawing Sheets

(56) References Cited

U.S. PATENT DOCUMENTS

| | | | | |
|---|---|---|---|---|
| 7,244,021 | B2 * | 7/2007 | Arai | 347/102 |
| 7,267,425 | B2 | 9/2007 | Kawase et al. | |
| 7,407,277 | B2 | 8/2008 | Yoneyama | |
| 7,524,014 | B2 | 4/2009 | Izuo | |
| 7,562,957 | B2 | 7/2009 | Mills et al. | |
| 7,798,602 | B2 * | 9/2010 | Kobayashi et al. | 347/37 |
| 7,920,297 | B2 | 4/2011 | Doggett, III et al. | |
| 8,201,908 | B2 | 6/2012 | Tanoue et al. | |
| 8,292,391 | B2 * | 10/2012 | Ishimoto et al. | 347/14 |
| 2002/0154182 | A1 | 10/2002 | Takahashi et al. | |
| 2003/0142168 | A1 | 7/2003 | Suzuki et al. | |
| 2004/0233249 | A1 | 11/2004 | Vanhooydonck | |
| 2005/0156965 | A1 | 7/2005 | Hoshino | |
| 2005/0162451 | A1 | 7/2005 | Suzuki et al. | |
| 2006/0158481 | A1 | 7/2006 | Spevak et al. | |
| 2008/0152413 | A1 * | 6/2008 | Yoshida et al. | 400/76 |
| 2009/0073204 | A1 | 3/2009 | Takekoshi et al. | |
| 2009/0160895 | A1 | 6/2009 | Matsuzawa | |
| 2010/0245440 | A1 | 9/2010 | Usuda et al. | |
| 2011/0025744 | A1 | 2/2011 | Ishimoto et al. | |
| 2011/0037800 | A1 | 2/2011 | Tanoue et al. | |

FOREIGN PATENT DOCUMENTS

| | | | | |
|---|---|---|---|---|
| JP | 2002-307672 | A | 10/2002 | |
| JP | 2003-285427 | A | 10/2003 | |
| JP | 2003-326779 | A | 11/2003 | |
| JP | 2003326779 | A * | 11/2003 | B41J 11/42 |
| JP | 2007-223139 | A | 9/2007 | |
| JP | 2008-221645 | A | 9/2008 | |

* cited by examiner

LIQUID EJECTING APPARATUS AND LIQUID EJECTING METHOD

RELATED APPLICATIONS

This application is a divisional of U.S. patent application Ser. No. 12/814,854, filed Jun. 14, 2010 and entitled "Liquid Ejecting Apparatus and Liquid Ejecting Method", which claims priority to JP Application No. 2009-175736, filed Jul. 28, 2009, the disclosures of which are incorporated herein by reference in their entirety.

BACKGROUND

1. Technical Field

The present invention relates to a liquid ejecting apparatus and a liquid ejecting method.

2. Related Art

One example of a liquid ejecting apparatus is an ink jet printer including nozzle rows in which nozzles ejecting ink (liquid) to a medium are arranged in a predetermined direction. Among the ink jet printer, there is known a printer repeating an operation of ejecting ink from nozzles while moving nozzle rows in a movement direction intersecting the predetermined direction and an operation of transmitting a medium relative to the nozzle rows in a transport direction which is the predetermined direction.

In such a printer, there is used a printing method of changing the number of nozzles to be used or a transport distance upon printing an upper end portion of the medium, when the nozzles form dot rows at an interval narrower than an interval (nozzle pitch) at which the nozzles are arranged, for example.

JP-A-2008-221645 is an example of related art.

In order to improve the chromogenic properties of an image, a background image may be printed with white ink and then an image may be printed with color ink on the background image. In this case, nozzles used to print the background image are fixed to half of nozzles of a white nozzle row on the upstream side in the transport direction. Nozzles used to print the color image are fixed to half of nozzles of a color ink nozzle row on the downstream side in the transport direction. Then, when the background image is printed by the white ink nozzles on the upstream side in the transport direction, a printing start position is located on the upstream side of a head in the transport direction. That is, the position control range of the medium may become long.

SUMMARY

An advantage of some aspects of the invention is that it provides a liquid ejecting apparatus and a liquid ejecting method capable of shortening a position control range of a medium as much as possible.

According to an aspect of the invention, there is provided a liquid ejecting apparatus including: a first nozzle row in which first nozzles ejecting a first liquid are arranged in a predetermined direction; a second nozzle row in which second nozzles ejecting a second liquid are arranged in the predetermined direction; a movement mechanism moving the first and second nozzle rows in a movement direction intersecting the predetermined direction relative to a medium; a transport mechanism transporting the medium in the predetermined direction relative to the first and second nozzle rows; and a control unit repeating an image forming operation of ejecting the liquids from the first and second nozzles while moving the first and second nozzle rows in the movement direction by the movement mechanism and a transport operation of transporting the medium in the predetermined direction relative to the first and second nozzle rows by the transport mechanism. When a first image is formed with the first liquid in a given image forming operation and then a second image is formed with the second liquid on the first image in another image forming operation, the control unit sets the first nozzles forming the first image to the nozzles located on an upstream side in the predetermined direction relative to the second nozzles forming the second image in forming the first and second images at a middle portion of the medium, and sets the first nozzles forming the first image to the nozzles located on a downstream side in the predetermined direction relative to the first nozzles, which form the first image at the middle portion of the medium, in forming the first and second images at an upper end portion of the medium.

Other aspects of the invention are apparent in the description of the disclosure and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview

Figure 1:
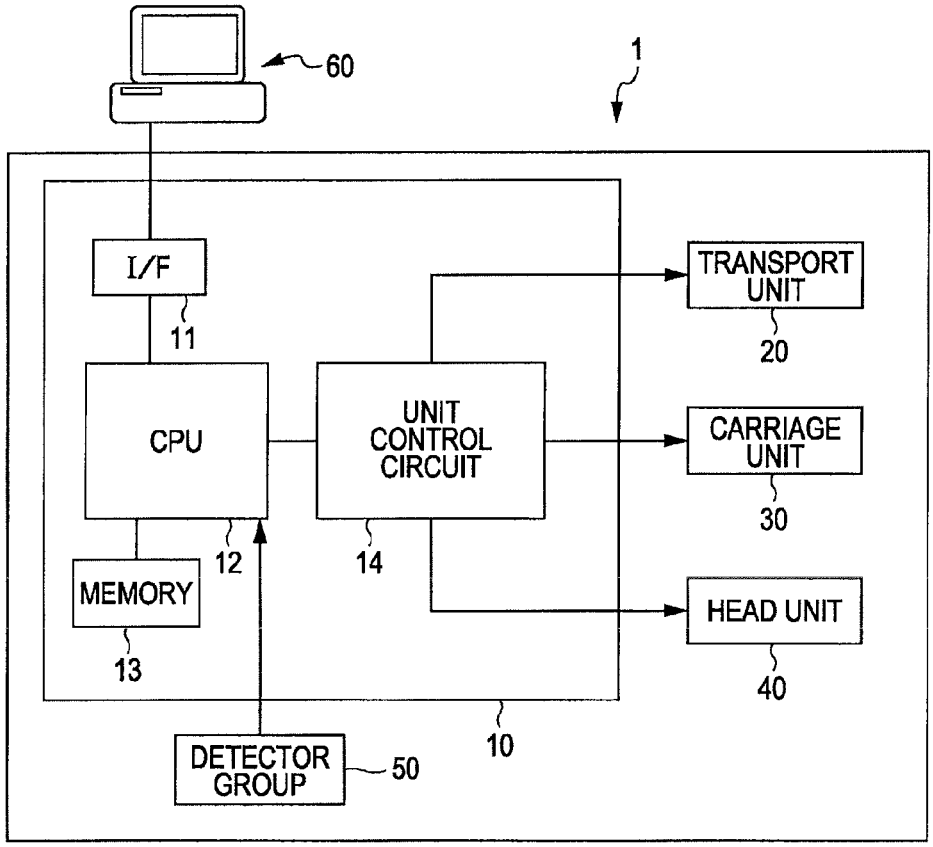
FIG. 1 is a block diagram illustrating the overall configuration of a printer.

The following aspects of the invention are apparent in the description of the disclosure and the accompanying drawings.

According to an aspect of the invention, there is provided a liquid ejecting apparatus including: a first nozzle row in which first nozzles ejecting a first liquid are arranged in a predetermined direction; a second nozzle row in which second nozzles ejecting a second liquid are arranged in the predetermined direction; a movement mechanism moving the first and second nozzle rows in a movement direction intersecting the predetermined direction relative to a medium; a transport mechanism transporting the medium in the predetermined direction relative to the first and second nozzle rows; and a control unit repeating an image forming operation of ejecting the liquids from the first and second nozzles while moving the first and second nozzle rows in the movement direction by the movement mechanism and a transport operation of transporting the medium in the predetermined direction relative to the first and second nozzle rows by the transport mechanism. When a first image is formed with the first liquid in a given image forming operation and then a second image is formed with the second liquid on the first image in another image forming operation, the control unit sets the first nozzles forming the first image to the nozzles located on an upstream side in the predetermined direction relative to the second nozzles forming the second image in forming the first and second images at a middle portion of the medium, and sets the first nozzles forming the first image to the nozzles located on a downstream side in the predetermined direction relative to the first nozzles, which form the first image at the middle portion of the medium, in forming the first and second images at an upper end portion of the medium.

In the liquid ejecting apparatus with the configuration, since a position control range of a medium can be shortened, it is possible to decrease a blank space at the upper end portion of the medium.

In the liquid ejecting apparatus according to the aspect of the invention, the sum of a distance, by which the first nozzles forming the first image in the next image forming operation are displaced to the upstream side in the predetermined direction relative to the first nozzles forming the first image in a given image forming operation, and a transport distance, by which the medium is transported in the predetermined direction in the transport operation, at the upper end portion of the medium may be equal to a transport distance by which the medium is transported in the predetermined direction in the transport operation at the middle portion of the medium.

In the liquid ejecting apparatus with the configuration, a liquid ejecting method (a method of forming dots) in forming at the upper end portion of the medium may be made close to a liquid ejecting method in forming at the middle portion of the medium. Therefore, for example, a time, in which the first image is formed and then the second image is formed, in forming at the upper end portion of the medium can be made equal to that in forming at the middle portion of the medium.

In the liquid ejecting apparatus according to the aspect of the invention, the distance, by which the first nozzles forming the first image in the next image forming operation are displaced to the upstream side in the predetermined direction relative to the first nozzles forming the first image in a given image forming operation in forming at the upper end portion of the medium, may be uniform.

In the liquid ejecting apparatus with the configuration, since the entire first nozzle row can be equally used, it is possible to make the transport distance of the medium uniform in forming at the upper end portion of the medium. Therefore, it is possible to stabilize the transport operation.

In the liquid ejecting apparatus according to the aspect of the invention, a time, in which the first image is formed at the middle portion of the medium and then the second image is formed at the middle portion of the medium, may be equal to a time, in which the first image is formed at the upper end portion of the medium and then the second image is formed at the upper end portion of the medium.

In the liquid ejecting apparatus with the configuration, for example, it is possible to prevent image concentration from being irregular.

In the liquid ejecting apparatus according to the aspect of the invention, in forming the first and second images at a lower end portion of the medium, the control unit may set the second nozzles forming the second image to the nozzles located on the upstream side in the predetermined direction relative to the second nozzles forming the second image in forming the first and second images at the middle portion of the medium.

In the liquid ejecting apparatus according to the aspect of the invention, it is possible to shorten the position control range of the medium. For example, it is possible to decrease a blank space at the lower end portion of the medium.

According to another aspect of the invention, there is provided a liquid ejecting method of forming a first image with a first liquid in a given image forming operation and then forming a second image with a second liquid on the first image in another image forming operation by a liquid ejecting apparatus that repeats the image forming operation of ejecting the liquids from a first nozzle row, in which first nozzles ejecting the first liquid are arranged in a predetermined direction, a second nozzle row, in which second nozzles ejecting the second liquid are arranged in the predetermined direction, while moving the first and second nozzle rows in a movement direction intersecting the predetermined direction and a transport operation of transporting the medium in the predetermined direction relative to the first and second nozzle rows. The liquid ejecting method includes: setting the first nozzles forming the first image to the nozzles located on the upstream side in the predetermined direction relative to the second nozzles forming the second image in forming the first and second images at a middle portion of the medium to eject the liquids; and setting the first nozzles forming the first image to the nozzles located on the downstream side in the predetermined direction relative to the first nozzles, which form the first image at the middle portion of the medium, in forming the first and second images at an upper end portion of the medium to eject the liquids.

According to the liquid ejecting method, it is possible to shorten the position control range of the medium. For example, it is possible to decrease the blank space at the upper end portion of the medium.

Printing System

Hereinafter, a serial type printer (hereinafter, referred to as a printer 1) of an ink jet printer, which is an example of a liquid ejecting apparatus, will be described according to an embodiment.

Figure 2A:
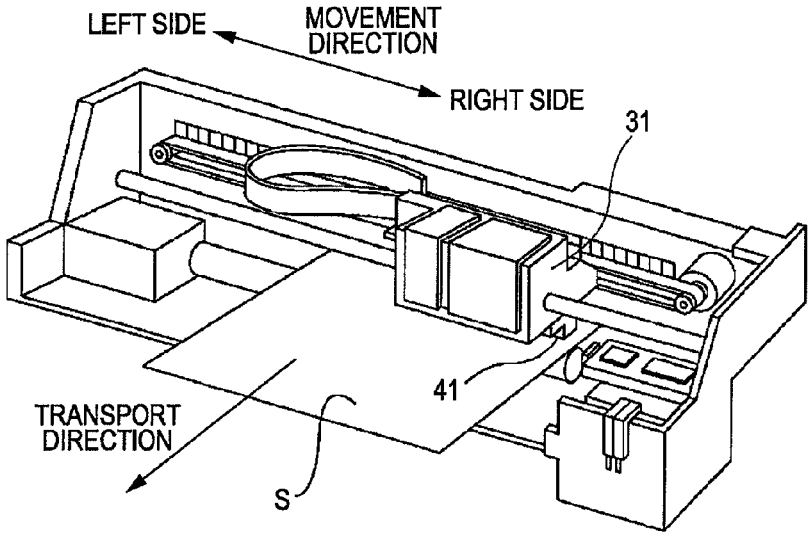
FIG. 2A is a perspective view illustrating the printer.
Figure 2B:
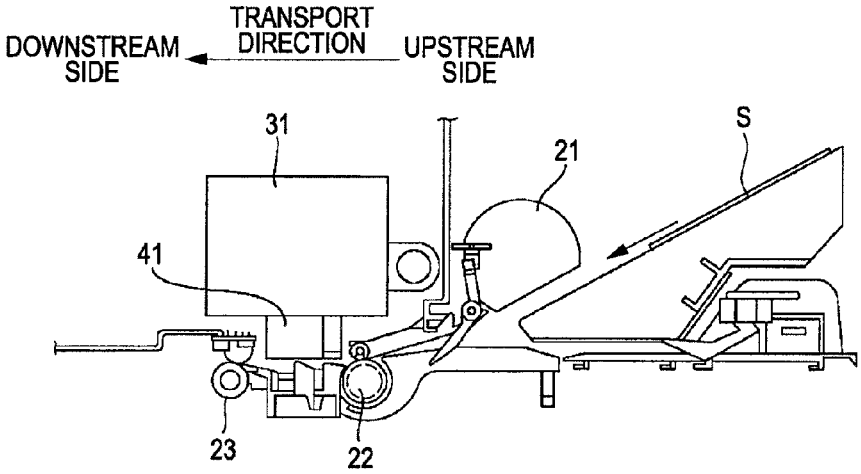
FIG. 2B is a sectional view illustrating the printer.

FIG. 1 is a block diagram illustrating the overall configuration of the printer 1. FIG. 2A is a perspective view illustrating the printer 1. FIG. 2B is a sectional view illustrating the printer 1. When the printer 1 receives print data from a computer 60, which is an external apparatus, a controller 10 controls units (a transport unit 20, a carriage unit 30, and a head unit 40) to form an image on a medium S (a paper sheet, a film, or the like). A detector group 50 monitors the state of the printer 1. The controller 10 controls the units on the basis of the detection result.

The controller 10 (control unit) is a control unit controlling the printer 1. An interface 11 transmits and receives data between the printer 1 and the computer 60, which is an external apparatus. A CPU 12 is an arithmetic processor controlling the entire printer 1. A memory 13 is used to guarantee an area or a work area to store programs of the CPU 12. The CPU 12 permit a unit control circuit 14 to control the units on the basis of a program stored in the memory 13.

The transport unit 20 (transport mechanism) transports the medium S to a printable position. The transport unit 20 transports the medium S by a predetermined transport distance in a transport direction (predetermined direction) upon printing. The transport unit 20 includes a feeding roller 21, a transporting roller 22, and a discharging roller 23. The transport unit 20 transports the printing target medium S to the transport roller 22 by rotating the feeding roller 21. The controller 10 determines the position of the printing start position of the medium S by rotating the transporting roller 22.

The carriage unit 30 (movement mechanism) moves a head 41 in a direction (hereinafter, referred to as a movement direction) intersecting the transport direction. The carriage unit 30 includes a carriage 31.

The head unit 40 ejects ink to the medium S and includes the head 41. The head 41 is moved in the movement direction by the carriage 31. A plurality of nozzles serving as ink ejecting portions is formed on the lower surface of the head 41. An ink chamber (not shown) filled with ink is disposed in each nozzle.

Figure 3:
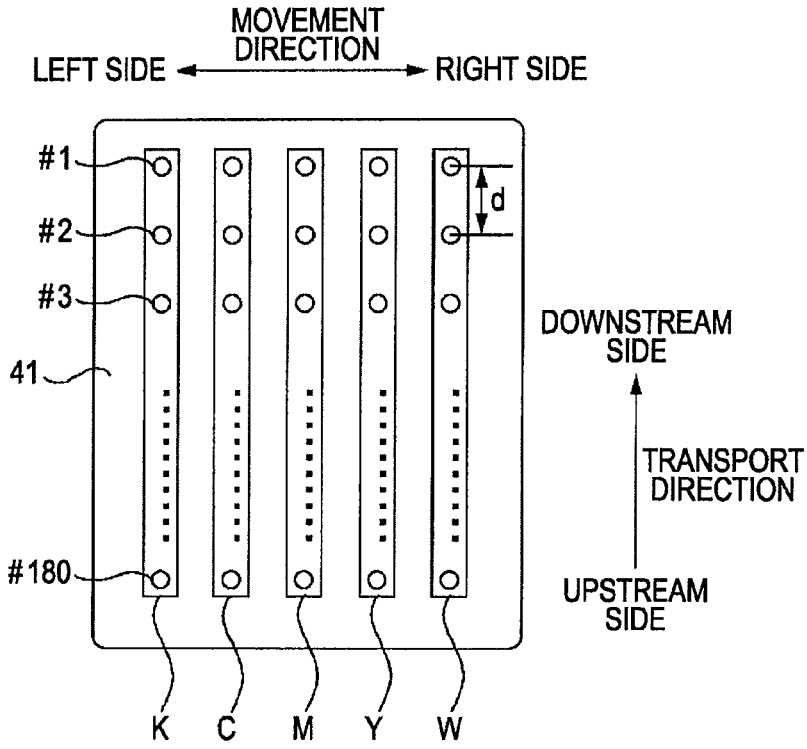
FIG. 3 is a diagram illustrating nozzle arrangement of the lower surface of a head.

FIG. 3 is a diagram illustrating nozzle arrangement of the lower surface of the head 41. Five nozzle rows in which 180 nozzles are arrange at a predetermined interval (nozzle pitch d) in the transport direction are formed on the lower surface of the head 41. As illustrated, a black nozzle row K ejecting black ink, a cyan nozzle row C ejecting cyan ink, a magenta nozzle row M ejecting magenta ink, a yellow nozzle row Y ejecting yellow ink, and a white nozzle row W ejecting white ink are arranged in order in the movement direction. Smaller numbers (#1 to #180) are given to the 180 nozzles of each nozzle row from the nozzles on the downstream side in the transport direction.

The printer 1 repeats a dot forming process of forming dots on the medium by ejecting ink droplets intermittently from the head 41 being moved in the movement direction and a transport process (corresponding to a transport operation) of transporting the medium relative to the head 41 in the transport direction. In this way, since dots can be formed on the medium at positions different from the positions of the dots formed by the previous dot forming process, a 2-dimensional image can be printed on the medium. A process (corresponding to a one-time image forming operation of the dot forming process) of moving the head 41 once in the movement direction while ejecting ink droplets is referred to as a "pass".

Printing Mode

In the printer 1 according to this embodiment, a "4-color printing mode" and a "5-color printing mode" can be selected. The "4-color printing mode" refers to a mode in which a color image is directly formed on the medium by the black nozzle row K, the cyan nozzle row C, the magenta nozzle row M, and the yellow nozzle row Y. That is, in the 4-color printing mode, ink droplets are ejected toward the medium from the four color nozzles YMCK (hereinafter, referred to as a "color nozzle row Co"). In monochrome printing, the 4-color printing mode is executed.

On the other hand, the "5-color printing mode" is a mode in which a background image (corresponding to a first image) is printed with white ink (corresponding to a first liquid) on the medium, and then a color image (corresponding to a second image) is printed with four kinds of color ink (YMCK) (corresponding to a second liquid) on the background image. That is, in the 5-color printing mode, ink droplets are ejected toward the medium from the white nozzle row W (corresponding to a first nozzle row), so that the ink droplets are ejected toward the background image from the color nozzle row Co (corresponding to a second nozzle row). In this way, it is possible to print an image with a good chromogenic property. The nozzles ejecting the white ink correspond to first nozzles. The nozzles ejecting the four kinds of ink correspond to second nozzles.

Specifically, in the 5-color printing mode, a background image is printed on a certain area of the medium by the white nozzle row W in the previous pass, and then a color image is printed on the background image printed in the certain area of the medium by the color nozzles row Co in the next pass. In this way, by differentiating the pass (the previous pass), where the background image is printed, and the pass (the next pass), where the color image is printed, in the same area of the medium, the color image can be printed after drying the background image. As a consequence, it is possible to prevent soaking of an image.

Transport Unit 20

Figure 4:
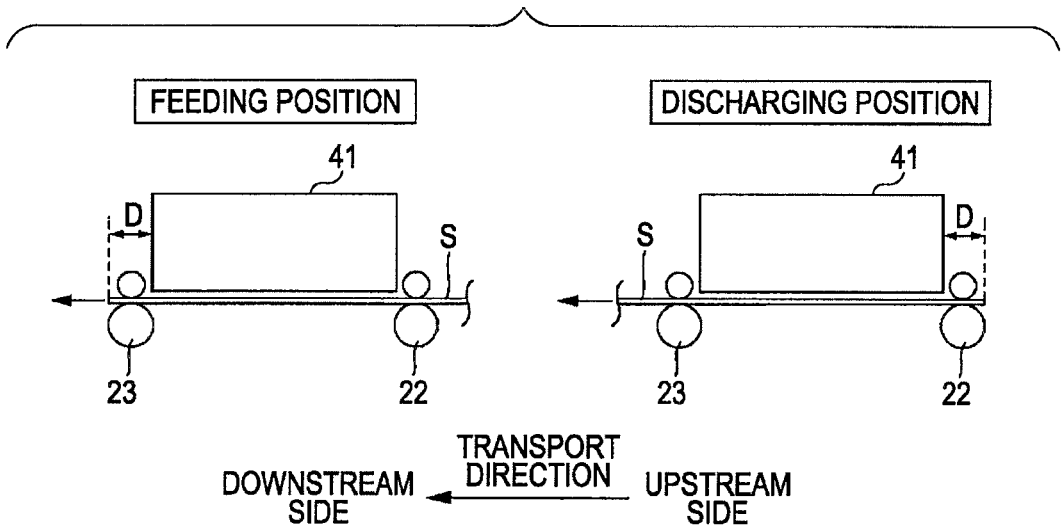
FIG. 4 is a diagram illustrating a feeding position and a discharging position of a transport unit.

FIG. 4 is a diagram illustrating a feeding position and a discharging position of the medium S by the transport unit 20 of the printer 1. In the printer 1 according to this embodiment, the medium S is printed in a state where the medium S is pinched between both of the transporting roller 22 and the discharging roller 23. In this way, the medium S can be transported stably. In the following description, of two end portions of the medium S in the movement direction, the end portion on the upstream side in the transport direction is referred to as an "upper end portion" and the end portion on the downstream side in the transport direction is referred to as a "lower end portion".

In the left part of FIG. 4, the position (a feeding position of the medium S) of the medium S relative to the head 41 upon starting the printing is shown. Here, a position, at which the upper end portion of the medium S is located on the downstream side in the transport direction by a distance D relative to the end of the head 41 on the downstream side in the transport direction, is referred to as a "feeding position (printing start position)". At the feeding position shown in the drawing, the printing can be started in a state where the medium S is pinched between the transporting roller 22 and the discharging roller 23.

On the other hand, in the right part of FIG. 4, a position (the discharging position of the medium S) of the medium S relative to the head 41 upon ending the printing is shown. Here, a position, at which the lower end portion of the medium is located on the upstream side in the transport direction by the distance D relative to the end of the head 41 on the upstream side in the transport direction, is referred to as a "discharging position (printing end position). At the discharging position shown in the drawing, the printing can end in a state where the medium S is pinched between the transporting roller 22 and the discharging roller 23.

Band Printing

4-Color Printing Mode

Figure 5:
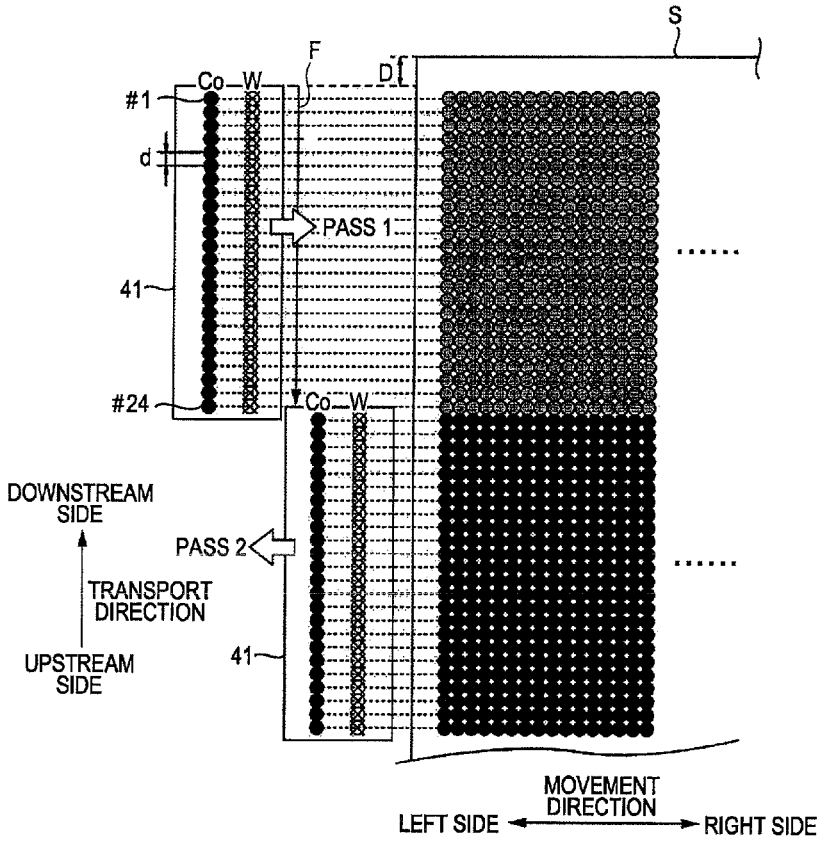
FIG. 5 is an explanatory diagram illustrating band printing in a 4-color printing mode.

FIG. 5 is a diagram illustrating band printing in the 4-color printing mode. For simple description, the number of nozzles of the head 41 is reduced (#1 to #24). The nozzle rows (YMCK) for four colors except for the white nozzle row W are together referred to as the "color nozzle row Co". In effect, in the printer 1, the medium S is transported in the transport direction relative to the head 41. In the drawing, the head 41 is moved in the transport direction relative to the medium S.

As shown in FIG. 4, upon starting the printing, the medium S is located on the downstream side in the transport direction by the distance D relative to the end of the head 41 on the downstream side in the transport direction. Therefore, in FIG.

5, the medium S is also located on the downstream side by the distance D relative to the end of the head 41 on pass 1 on the downstream side in the transport direction.

In the 4-color printing mode, as described above, the color image is printed directly on the medium S by the nozzle rows (YMCK=the color nozzle row Co) for four colors. Therefore, in the 4-color printing mode, the white ink is not ejected from the white nozzle row W. In the 4-color printing mode, all of the nozzles belonging to the color nozzle row Co are nozzles (hereinafter, referred to as ejectable nozzles) that can be used in the printing. However, the invention is not limited thereto. Even in the 4-color printing mode, all of the nozzles belonging to the color nozzle row Co may not be set to be the ejectable nozzles. For example, as in the 5-color printing mode, which is described, half of the nozzles of the color nozzle row Co may be set to be the ejectable nozzles.

Banding printing refers to a printing method of forming an image by arranging an image (band image) with a width, which is formed by one-time movement (pass) of the head 41 in the movement direction, in the transport direction. Here, since the number of all nozzles belonging to the color nozzle row Co is twenty four, one band image is organized by twenty four raster lines (dot rows in the movement direction). In FIG. 5, a band image formed by initial pass 1 is indicated by gray dots and a band image formed by next pass 2 is indicated by black dots.

That is, in the band printing, there are alternately repeated an operation of forming a band image by ejecting ink droplets from the color nozzle row Co during movement of the head 41 and an operation of transporting the medium S by a width F of the band image. Therefore, in the band printing, no raster line is formed by another pass between raster lines formed by given passes. That is, in the band printing, the gap between the raster lines is a nozzle pitch d.

5-Color Printing Mode According to Comparative Example

Figure 6A:
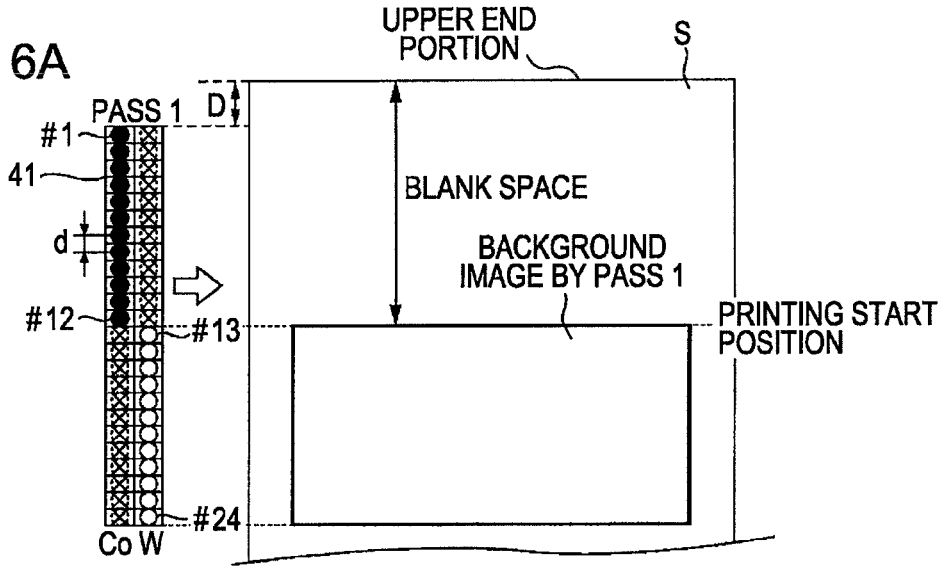
FIGS. 6A and 6B are diagrams illustrating printing of an upper end portion of a medium in the band printing in a 5-color printing mode according to a comparative example.
Figure 6B:
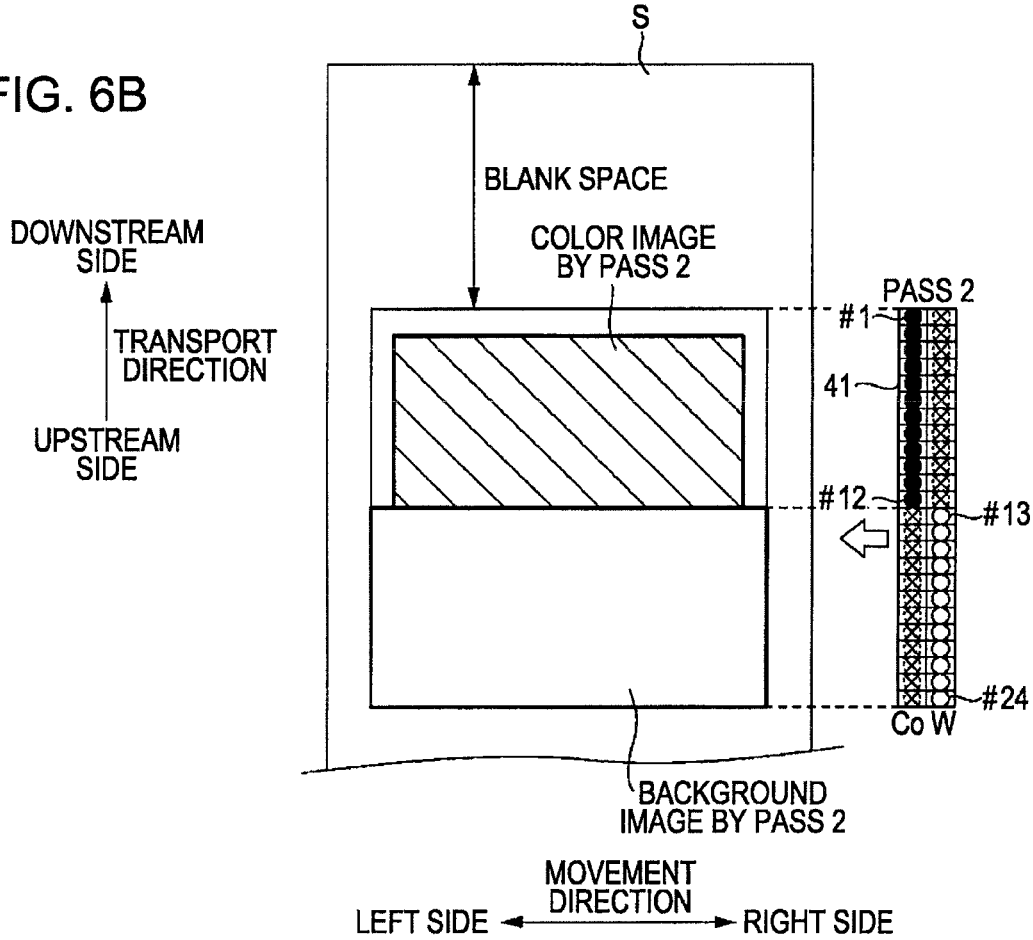
Figure 7A:
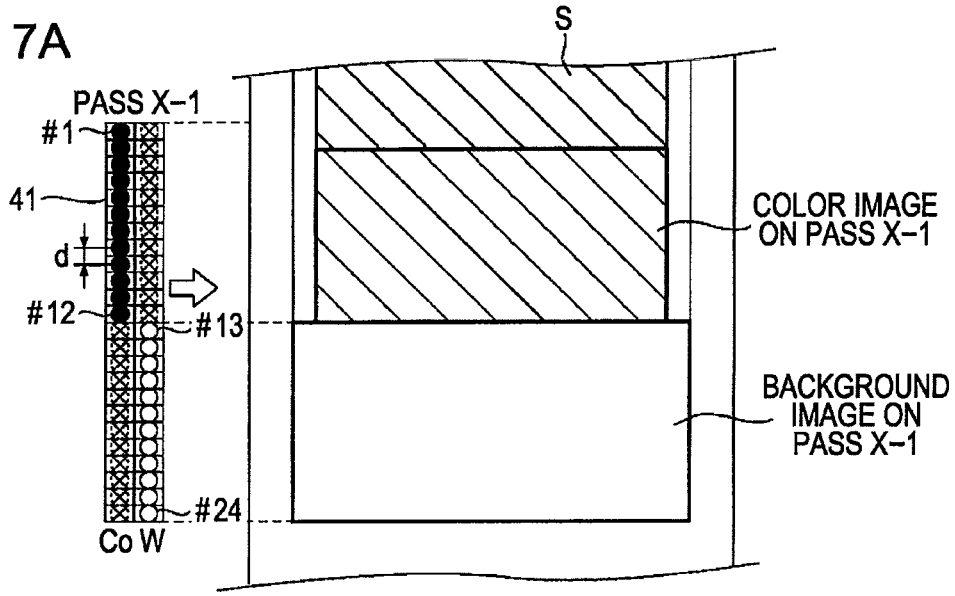
FIGS. 7A and 7B are diagrams illustrating printing of a lower end portion of the medium in the band printing in the 5-color printing mode according to the comparative example.
Figure 7B:
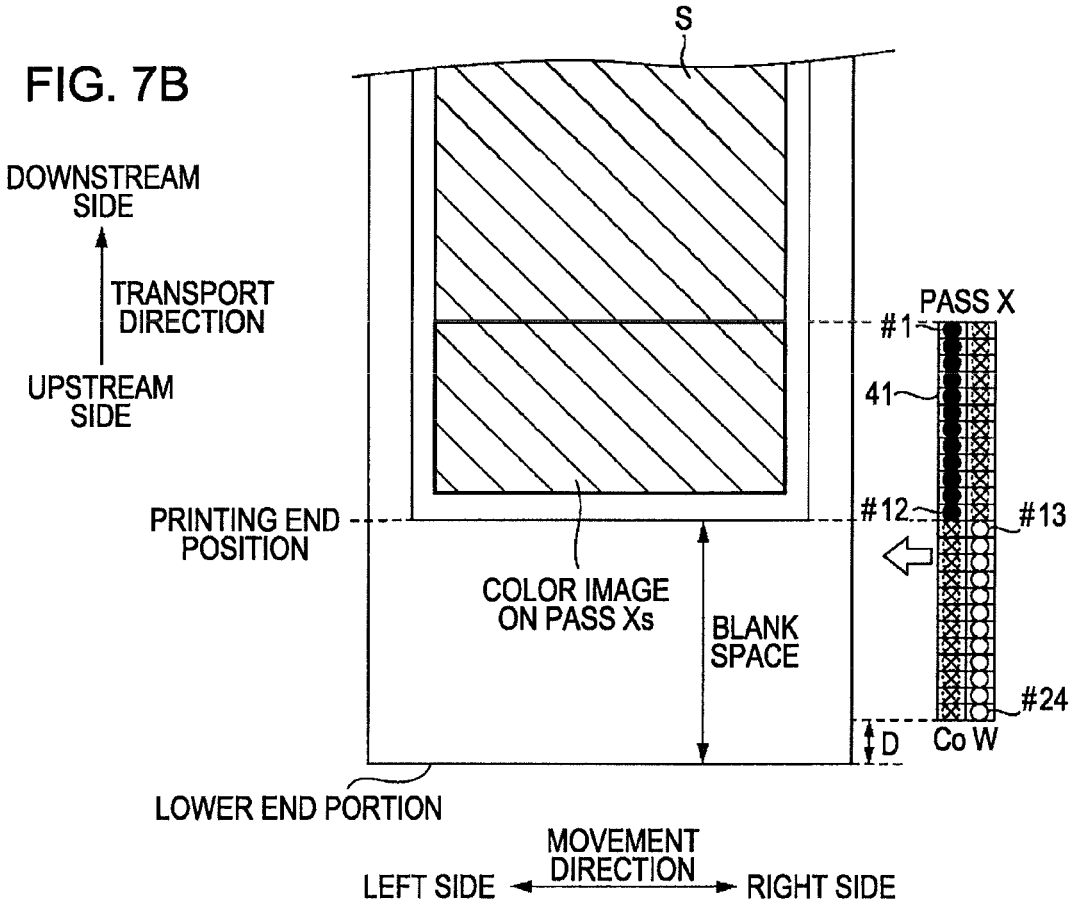

FIGS. 6A and 6B are diagrams illustrating printing of the upper end portion of the medium S in the band printing in the 5-color printing mode according to a comparative example. FIGS. 7A and 7B are diagrams illustrating printing of the lower end portion of the medium S in the band printing in the 5-color printing mode according to the comparative example. A portion (initially printed portion) of the medium S on the upstream side in the transport direction is the upper end portion of the medium S. A portion (finally printed portion) of the medium S on the downstream side in the transport direction is the lower end portion of the medium S. For simple description, the number of nozzles belonging to each of the nozzle rows Co and W is reduced (#1 to #24). In the drawing, each nozzle is shown in a square mass. The distance of one mass in the transport direction corresponds to a nozzle pitch d.

In the 5-color printing mode, as described above, a background is printed by the white nozzle row W, and then a color image is printed on the background image at another pass by the color nozzle row Co (=YMCK). In a 5-color printing mode according to a comparative example, the half (#13 to #24) of the nozzles of the white nozzle row W which are on the upstream side in the transport direction are set to nozzles for printing a background image. The half (#1 to #12) of the nozzles of the color nozzle row Co (=YMCK) which are on the downstream side in the transport direction are set to nozzles for printing a color image. Here, it is assumed that the white ink is not ejected from the half (#1 to #12) of the nozzles of the white nozzle row W which are on the downstream side in the transport direction. In addition, it is assumed that no ink is ejected from the half (#13 to #24) of the nozzles of the color nozzle row Co which are on the upstream side in the transport direction.

Next, a specific printing method will be described. First, as shown in FIG. 6A, upon starting printing (at feeding position), the upper end portion of the medium S is located on the downstream side in the transport direction by a distance D relative to the end of the head 41 (on pass 1) on the downstream side in the transport direction. Subsequently, on pass 1, the background image is printed by the nozzles #13 to #24 of the white nozzle row W on the upstream side in the transport direction. Then, the background image (indicated by a heavy line) formed by the twelve nozzles (#13 to #24) of the white nozzle row W is organized by twelve raster lines. Moreover, on pass 1, no ink is ejected from the color nozzle row Co.

Subsequently, the medium S is transported by the width (the pitch of twelve nozzles=12 d) of the background image printed on pass 1. Subsequently, on pass 2, the background (indicated by the heavy line) is printed by the nozzles #13 to #24 of the white nozzle row W on the upstream side in the transport direction. As a consequence, the background image printed on pass 1 and the background printed on pass 2 are arranged in the transport direction. In addition, on pass 2, a color image (indicated by a diagonal line) is printed by the nozzles #1 to #12 of the color nozzle row Co on the downstream side in the transport direction. As a consequence, the color image is printed on pass 2 on the background image formed on pass 1.

Subsequently, there are alternately repeated an operation of forming the background image by the nozzles #13 to #24 of the white nozzle row W on the upstream side in the transport direction and forming the color image on the background image formed on the previous pass by the nozzles #1 to #12 of the color nozzle row Co on the downstream side in the transport direction and the operation of transporting the medium S in the transport direction by a distance (12 d, 12 mass) corresponding to twelve nozzles. In this way, the color image is printed at the next pass on the background image printed at the previous pass to complete a printing product in which the color image is printed on the background image.

That is, the nozzles (#13 to #24) printing the background image are set to nozzles located on the upstream side in the transport direction relative to the nozzles (#1 to #12) printing the color image. In this way, the background image can be printed in a certain area of the medium S on the previous pass, and then the color image can be printed on the background image on the next pass.

In the printing method according to the comparative example, as shown in FIG. 6A, the position of the raster line formed by the middle nozzle #13 of the white nozzle row W is the printing start position in the state where the upper end portion of the medium S is located on the downstream side by the distance D relative to the end of the head 41 on the downstream side in the transport direction. In other words, the sum of the distance D, by which the upper end portion of the medium S exceeds the head 41 upon starting the printing, and the distance (the distance corresponding to the nozzles printing no background image) corresponding to twelve nozzles is a blank space at the upper end portion of the medium S.

On the other hand, in the 4-color printing mode shown in FIG. 5, the position of the raster line formed by the lowermost nozzle #1 is the printing start position in a state where the upper end portion of the medium S is located on the downstream side by the distance D relative to the end of the head 41 on the downstream side in the transport direction. Therefore, in the 5-color printing mode according to the comparative example, the blank space may be increased more than in the 4-color printing mode shown in FIG. 5 at the upper end portion of the medium S. This is because in the 5-color printing mode according to the comparative example, the nozzles printing the background image on the medium earlier are set to the half (#13 to #24) of the nozzles of the white ink nozzle row W on the upstream side in the transport direction. Therefore, the printing start position is the position on the upstream side relative to the head 41.

FIGS. 7A and 7B are diagrams illustrating printing of the lower end portion of the medium S. As shown in FIG. 7A, on pass X-1 right before the final pass, a color image is printed on a background image by the half (#1 to #12) of the nozzles of the color nozzle row Co on the downstream side in the transport direction, and the background image is printed by the half (#13 to #24) of the nozzles of the white nozzle row W which are on the upstream side in the transport direction. Subsequently, the medium S is transported by a distance (12 d) corresponding to twelve nozzles.

Subsequently, at the final X (see FIG. 7B), the ink is ejected from the nozzles (#1 to #12) of the color nozzle row Co on the downstream side in the transport direction toward the background image printed on the previous pass X-1, and no ink is ejected from the white nozzle row W. In this way, the color image can be printed on the entire background image, and the printing ends.

In the printer 1 according to this embodiment, the printing ends in the state where the lower end portion of the medium S is located on the upstream side by the distance D relative to the end of the head 41 on the upstream side in the transport direction at the final pass X. Therefore, the position of the raster line formed by the middle nozzle #12 of the color nozzle row Co is the printing end position in the state where the lower end portion of the medium S is located on the upstream side by the distance D relative to the end of the head 41 on the upstream side in the transport direction. In other words, the sum of the distance D by which the lower end portion of the medium S exceeds the head 41 upon ending the printing and the distance (the distance corresponding to the nozzles printing no color image) corresponding to twelve nozzles is a blank space at the lower end portion of the medium S.

In the 4-color printing mode (not shown), the position of the raster line formed by the uppermost nozzle #24 on the upstream side is the printing end position in the state where the lower end portion of the medium S is located on the upstream side by the distance D relative to the end of the head 41 on the upstream side in the transport direction. Therefore, in the 5-color printing mode according to the comparative example, the blank space may be increased more than in the 4-color printing mode at the lower end portion of the medium S. This is because in the 5-color printing mode according to the comparative example, the nozzles printing the color image are set to the half (#1 to #12) of the nozzles of the color nozzle row Co on the downstream side in the transport direction. Therefore, the printing end position is the position on the downstream side in the transport direction relative to the head 41.

Therefore, in the 5-color printing mode according to the comparative example, the printing start position is a position on the upstream side in the transport direction relative to the head 41, and the printing end position is a position on the downstream side in the transport direction relative to the head 41. For this reason, the range (distance by which the position of the medium S is controlled in the transport direction) in which the position of the medium S during the printing is controlled may become longer.

When the printing is executed in the state where the medium S is pinched between the transporting roller 22 and the discharging roller 23 (see FIG. 4), as in the printer 1 according to this embodiment, the blank space may be increased at the upper end portion of the medium S upon starting the printing, as shown in FIG. 6A. On the other hand, the blank space may be increased at the lower end portion of the medium S upon ending the printing, as shown in FIG. 7B. For this reason, the size of the image printable on the medium S may be decreased or the size of the medium S has to be increased.

Figure 8A:
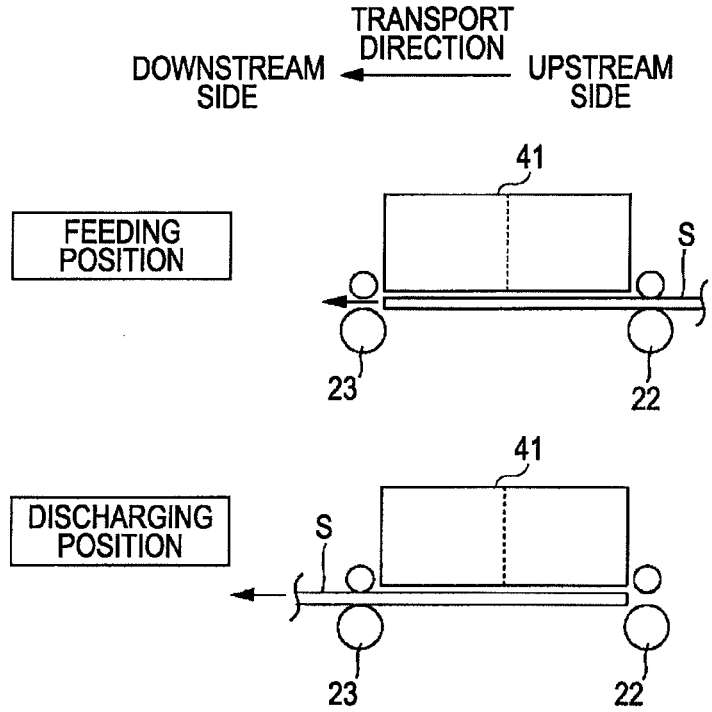
FIGS. 8A and 8B are diagrams illustrating a feeding position and a discharging position of a medium in a printer including another transport unit.
Figure 8B:
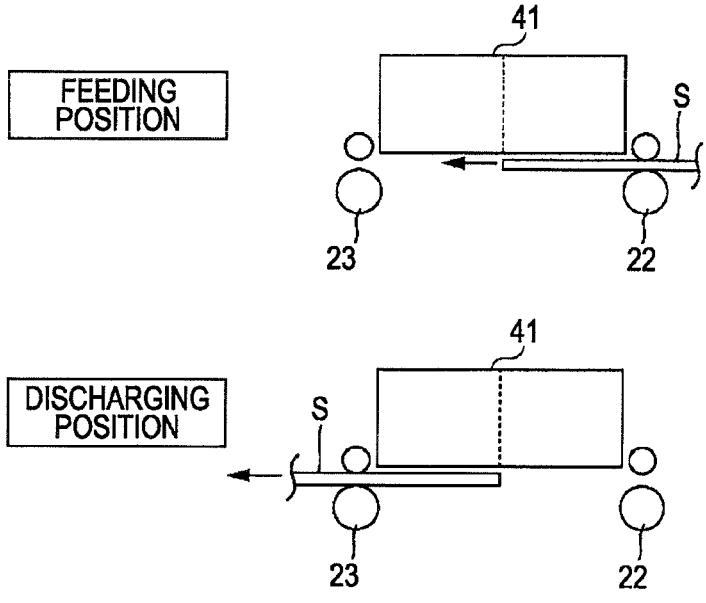

FIGS. 8A and 8B are diagrams illustrating the feeding position and the discharging position of the medium S in a printer including another transport unit 20. The invention is not limited to the printer executing the printing in the state where the medium S is pinched between both the transporting roller 22 and the discharging roller 23. The invention is applicable to a printer executing the printing in a state where the medium S is pinched by one of the transporting roller and the discharging roller. That is, a printer may be used in which the feeding position (head position) and the discharging position are variable.

For example, when the 4-color printing mode is executed in this printer (only a color image is printed on the medium), the feeding position and the discharging position of the medium S are shown in FIG. 8A. Since all of the nozzles belonging to the color nozzle row Co are used in the 4-color printing mode, the upper end portion of the medium S can be located on the downstream side in the transport direction relative to the head 41 upon starting the printing and the lower end portion of the medium S can be located on the upstream side in the transport direction relative to the head 41 upon ending the printing.

On the contrary, when the 5-color printing mode (band printing) is executed according to the comparative example, the feeding position and the discharging position of the medium S are shown in FIG. 8B. In the 5-color printing mode according to the comparative example, since half of the nozzles of the white nozzle row W on the upstream side in the transport direction are used, as shown in FIG. 6A, the upper end portion of the medium S is located on the upstream side in the transport direction relative to the head 41 upon starting the printing. Upon ending the printing, as shown in FIG. 7B, half of the nozzles of the color nozzle row Co on the downstream side in the transport direction are used. Therefore, the lower end portion of the medium S is located on the downstream side in the transport direction relative to the head 41.

In the case of the printer executing the printing in the state where the medium S is pinched by one of the transporting roller 22 and the discharging roller 23, the blank space of the medium S can be decreased even in the 5-color printing mode according to the comparative example. However, when the medium S is fed and discharged (the 5-color printing mode according to the comparative example), as shown in FIG. 8B, in comparison to the case where the medium S can be fed and discharged (the 4-color printing mode according to the comparative example), as shown in FIG. 8A, the position control range of the medium S becomes longer. Therefore, a transport error may easily occur. For example, when a sensor on the upstream side in the transport direction detects the upper end portion of the medium S and then the position of the medium S in the transport direction is controlled by the degree of rotation (the degree of transport) of the transporting roller 22, as the range of transport control may become longer, a transport error may more easily occur.

When the feeding position is located on the upstream side in the transport direction relative to the head 41, as shown in FIG. 8B, a protruding portion of the medium S to the upstream side in the transport direction relative to the head 41 becomes larger. Similarly, when the discharging position is located on the downstream side in the transport direction relative to the head 41, a protruding portion of the medium S to the downstream side in the transport direction relative to the head 41 becomes larger. For this reason, the size of the transport unit 20 may be larger or sheet jamming of the medium S may easily occur.

In the 5-color printing mode according to the comparative example, the printing start position is located on the upstream side in the transport direction relative to the head 41 and the printing end position is located on the downstream side in the transport direction relative to the head 41. That is, the position control range of the medium S may become long. For this reason, a transport error may easily occur, the blank space of the medium S may become larger, or the protruding portion of the medium S from the head 41 may become larger. Therefore, the size of the transport unit 20 may be increased.

An advantage of this embodiment is to shorten the position control range of the medium S as much as possible to when a color image is printed on a background image (5-color printing mode). In other words, an advantage of this embodiment is to set the printing start position to the downstream side in the transport direction and set the printing end position to the upstream side in the transport direction.

5-Color Printing Mode According to Embodiment

Figure 9:
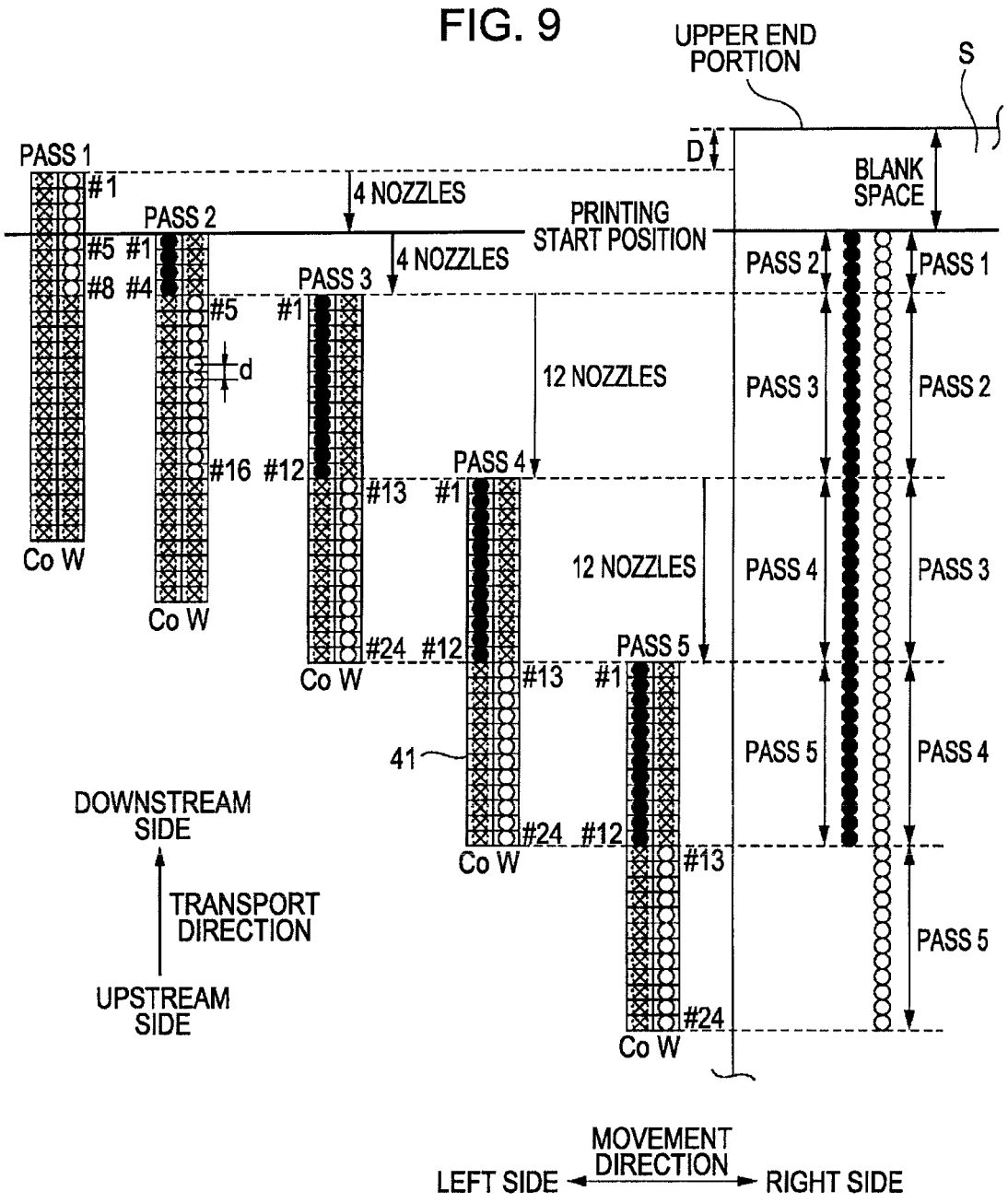
FIG. 9 is a diagram illustrating printing of the upper end portion of the medium in the band printing in the 5-color printing mode according to an embodiment.
Figure 10:
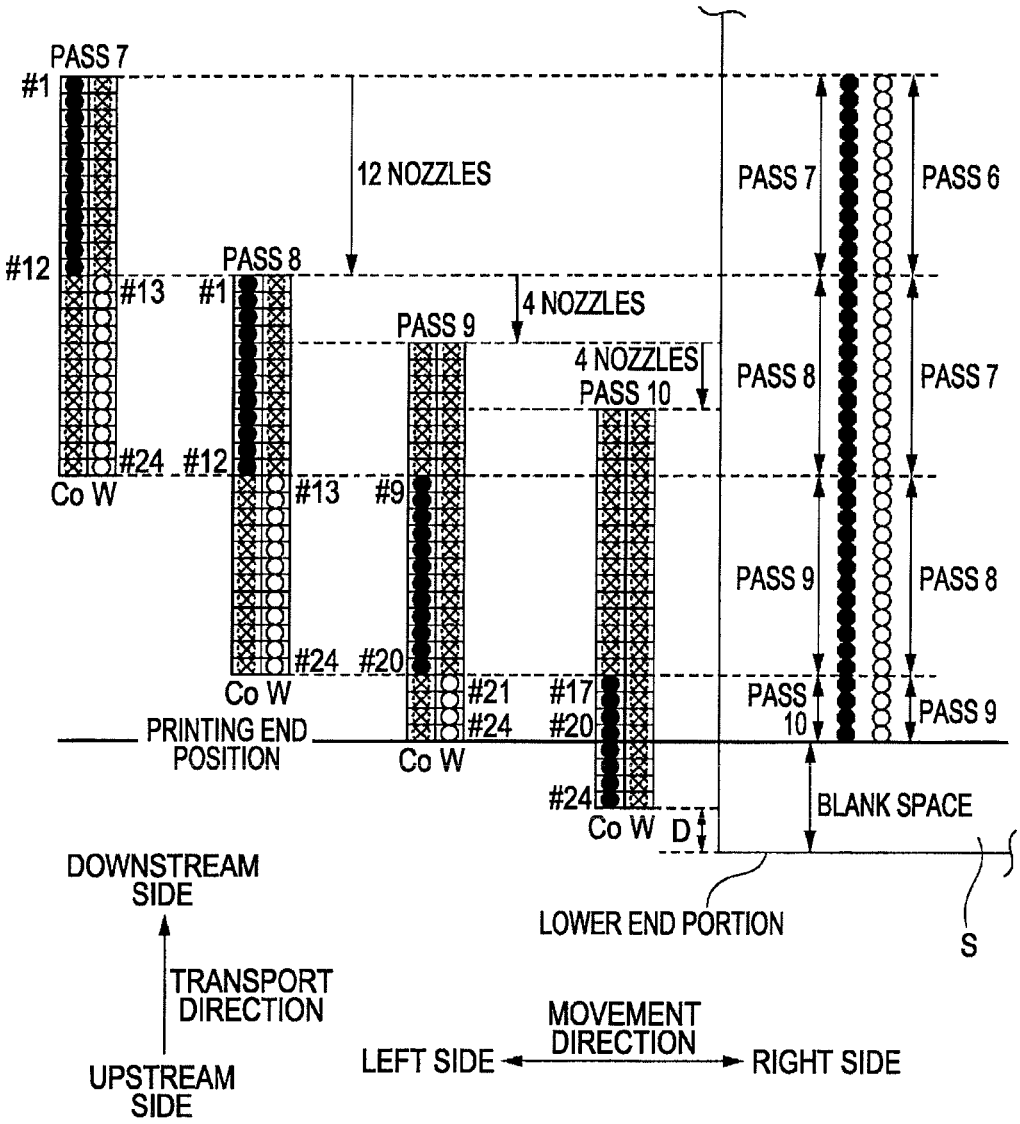
FIG. 10 is a diagram illustrating printing of the lower end portion of the medium in the band printing in the 5-color printing mode according to the embodiment.

FIG. 9 is a diagram illustrating printing of the upper end portion of the medium S in the band printing in the 5-color printing mode according to this embodiment. FIG. 10 is a diagram illustrating printing of the lower end portion of the medium S in the band printing in the 5-color printing mode according to this embodiment. For simple description, the number of nozzles belonging to each of the nozzles rows Co and W is reduced to twenty four. Ink ejecting nozzles of the color nozzle row Co are indicated by black circles and ink ejecting nozzles of the white nozzle row W are indicated by white circles.

In the 5-color printing mode (see FIGS. 6 and 7) according to the above-described comparative example, the nozzles printing the background image are set to the half (#13 to #24) of the nozzles of the white nozzle row W on the upstream side in the transport direction, and the nozzles printing the color image are set to the half (#1 to #12) of the nozzles of the color nozzle row Co on the downstream side in the transport direction.

However, in the 5-color printing mode according to this embodiment, the nozzles of the white nozzle row W on the downstream side in the transport direction also print the background image. Moreover, the nozzles of the color nozzle row Co on the upstream side in the transport direction also print the color image.

First, the printing of the upper end portion of the medium S will be described in detail. As shown in FIG. 9, upon starting the printing, the feeding position is a position at which the upper end position of the medium S is deviated only by the distance D on the downstream side in the transport direction relative to the end of the head 41 of pass 1 on the downstream side in the transport direction. In this embodiment, on pass 1, eight nozzles (#1 to #8) of the white nozzle row W on the downstream side are set to ejectable nozzles (nozzles usable in the printing). However, the medium S is transported by a distance corresponding to four nozzles (4 d, 4 mass) after pass 1, ink droplets are ejected from four nozzles (#5 to #8) on the upstream side in the transport direction among the ejectable nozzles (#1 to #8) on pass 1 to print the background image. On pass 1, no ink droplets are ejected from the color nozzle row Co.

Next, on pass 2, the ink droplets are ejected from the nozzles #1 to #4 of the color nozzle row Co on the downstream side in the transport direction. The position of the medium facing the nozzles #1 to #4 of the color nozzle row Co on pass 2 is the same as the position of the medium facing the nozzles #5 to #8 of the white nozzle row W on the previous pass 1. For this reason, on pass 2, the color image can be printed on the background image printed on pass 1. On pass 2, the background image is printed by the twelve nozzles #5 to #16 of the white nozzle row W. Subsequently, the medium S is transported by a distance corresponding to four nozzles.

On pass 3, the ink droplets are ejected from the half (#1 to #12) of the nozzles of the color nozzle row Co on the downstream side in the transport direction, and the ink droplets are ejected from the half (#13 to #24) of the nozzles of the white nozzle row W on the upstream side in the transport direction. The position of the medium facing the nozzles #1 to #12 of the color nozzle row Co on pass 3 is the same as the position of the medium facing the nozzles #5 to #16 of the white nozzle row W on pass 2. Therefore, on pass 3, the color image can be printed on the background image printed on pass 2. Subsequently, the medium S is transported to the downstream side in the transport direction by a distance corresponding to twelve nozzles.

Subsequently (after pass 4), there are alternately repeated an operation of printing the color image by the half (#1 to #12) of the nozzles of the color nozzle row Co on the downstream side in the transport direction and printing the background image by the half (#13 to #24) of the nozzles of the white nozzle row W on the upstream side in the transport direction and an operation of transporting the medium S by the distance corresponding to twelve nozzles. In this way, the color image can be printed on the next pass on the background image printed on the previous pass.

Printing executed by varying the number of nozzles used, the nozzle position, and the transport distance of the medium to form dots at the upper end portion (the portion on the downstream side in the transport direction) of the medium S, like a normal portion (middle portion) of the medium S, is referred to as "upper end printing". On the other hand, printing executed by fixing the number of nozzles used, the nozzle position, and the transport distance of the medium is referred to as "normal printing". Here, at a pass at which the number of nozzles used or the nozzle position are different from those of the normal printing, the upper end printing is executed. When the transport distance of the medium after a given pass is different from that of the normal printing, the upper end printing is executed. Therefore, in FIG. 9, the operation from pass 1 to the transport operation of pass 2 corresponds to the upper end printing (upon forming an image at the upper end portion of the medium). An operation after pass 3 corresponds to the normal printing (upon forming an image at the middle portion of the medium).

In summary, in the normal printing according to this embodiment, the nozzles printing the background image are set to the half (#13 to #24) of the white nozzle row W on the upstream side in the transport direction, and the nozzles printing the color image are set to the half (#1 to #12) of the nozzles of the color nozzle row Co on the downstream side in the transport direction. In the normal printing, the number of nozzles printing each of the background image and the color image is not limited to the method of setting the number (twelve nozzles in the drawing) of nozzles to half of the nozzles of the nozzle row. By locating the nozzles printing the background image to the upstream side in the transport direction relative to the nozzles printing the color image, the color image can be printed on the background image at the pass subsequent to the pass at which the background image is printed.

In the upper end printing according to this embodiment, the background image is printed using nozzles different from the nozzles (#13 to #24) printing the background image in the normal printing. More specifically, the nozzles printing the background image printing the background image in the upper end printing according to this embodiment are set to be the nozzles located on the downstream side in the transport direction relative to the nozzles printing the background image in the normal printing.

When the controller 10 of the printer 1 allocates data to the nozzles of the white nozzle row W on the downstream side in the transport direction to print the upper end portion of the medium, the controller 10 corresponds to a control unit and the printer 1 corresponds to a liquid ejecting apparatus. However, the invention is not limited thereto. When a printer driver of the computer 60 connected to the printer 1 allocates the data to the nozzles of the white nozzle row W on the downstream side in the transport direction to print the upper end portion of the medium, the printing system, to which the computer 60 and the controller 10 of the printer 1 are connected, correspond to the control unit and the computer 60 and the printer 1 correspond to the liquid ejecting apparatus.

As a consequence, in the comparative example (see FIG. 6A), the position of the raster line formed by the nozzle #13 of the head 41 on pass 1 is the printing start position. In this embodiment, however, the position of the raster line formed by the nozzle #5 of the head 41 on pass 1 is the printing start position (indicated by the heavy line), as shown in FIG. 9. Accordingly, in this embodiment, since the printing start position can be located on the downstream side in the transport direction, it is possible to shorten the position control range of the medium S in comparison to the comparative example. As a consequence, it is possible to decrease the blank space of the medium S. Specifically, in the comparative example, the sum of the protruding portion D of the upper end portion of the medium from the head 41 upon starting the printing and the distance corresponding to twelve nozzles is the blank space. In this embodiment, however, the sum of the protruding portion D of the upper end portion of the medium from the head 41 upon starting the printing and the distance corresponding to four nozzles is the blank space.

In a printer in which the feeding position (head position) of the medium S is variable, the printing start position is located on the downstream side in the transport direction relative to the head 41 in the upper end printing according to this embodiment. Therefore, the printing can be started at the feeding position shown in FIG. 8A. this embodiment, from this fact, it can be known that the position control range of the medium S is shortened in comparison to the comparative example (see FIG. 8B).

In the comparative example (see FIGS. 6A and 6B), the nozzles printing the background image are set to the half (#13 to #24) of the nozzles of the white nozzle row W on the upstream side in the transport direction. Therefore, according to the comparative example, no ink droplets are ejected from the half (#1 to #12) of the white nozzle row W on the downstream side in the transport direction. Therefore, since the ink thickens in the nozzles (#1 to #12) of the white nozzle row W on the downstream side in the transport direction, ejection failure may occur. In this embodiment, however, there are used not only half of the nozzles of the white nozzle row W on the upstream side in the transport direction but also the nozzles thereof on the downstream side in the transport direction. Therefore, it is possible to prevent the ink from thickening in the nozzles of the white nozzle row W on the downstream side in the transport direction. That is, in this embodiment, since there are used not only the nozzles of the white nozzle row W on the upstream side in the transport direction but also the nozzles thereof on the downstream side in the transport direction, it is possible to prevent the ink from thickening in the nozzles of the white nozzle row W on the downstream side in the transport direction, in comparison to the comparative example.

When ejection failure may occur in the nozzles on the upstream side in the case where only the nozzles of the white nozzle row W on the upstream side are used as in the comparative example, the nozzles in which the ejection failure occurs have a large influence. In this embodiment, however, not only the nozzles on the upstream side but also the nozzles on the downstream side are used to use numerous nozzles. Therefore, it is possible to reduce differences in the characteristics of the nozzles.

Next, the printing of the lower end portion of the medium S will be described in detail with reference to FIG. 10. In FIG. 10, the printing is completed on pass 10. There are repeated an operation of printing the color image by the half (#1 to #12) of the nozzles of the color nozzle row Co on the downstream side in the transport direction and printing the background image by the half (#13 to #24) of the white nozzle row W on the upstream side in the transport direction by the normal printing (upon forming an image at the middle portion of the medium) up to pass 7 and an operation of transporting the medium S by the distance corresponding to twelve nozzles.

On pass 8, an image is printed by half of the nozzles of the color nozzle row Co on the downstream side in the transport direction and half of the nozzles of the white nozzle row W on the upstream side in the transport direction, and then the medium S is transported by the distance corresponding to four nozzles. Subsequently, on pass 9, the color image is printed by the twelve nozzles #9 to #20 of the color nozzle row Co, and the background image is printed by the four nozzles #21 to #24 of the white nozzle row W. The position of the medium facing the nozzles #9 to #20 of the color nozzle row Co on pass 9 is the same as the position of the medium facing the nozzles #13 to #24 of the white nozzle row W on pass 8. Therefore, on pass 9, the color image can be printed on the background image printed on pass 8. Subsequently, the medium S is transported by the distance corresponding to four nozzles.

On pass 10, the eight nozzles (#17 to #24) of the color nozzle row Co on the upstream side in the transport direction are set to ejectable nozzles. However, on pass 9 before pass 10, the background image is printed only by the four nozzles (#21 to #24) of the white nozzle row W. Therefore, the ink is ejected from the four nozzles (#17 to #20) on the downstream side in the transport direction among the eight ejectable nozzles (#17 to #24) of the color nozzle row Co on pass 10. As a consequence, on pass 9, the color image can be printed on the background image formed on pass 10. In addition, on pass 10, no ink droplets are ejected from the white nozzle row W.

In order to form dots in the lower end portion of the medium S like the upper end portion or the normal portion of the medium, the printing is executed by varying the number of nozzles used, the nozzle position, and the transport distance of the medium. This printing is referred to as "lower end printing". Here, at a pass at which the number of nozzles used or the nozzle position are different from those of the normal printing, the lower end printing is executed. When the transport distance of the medium after a given pass is different from that of the normal printing, the lower end printing is executed. Therefore, in FIG. 10, the operation up to pass 7 corresponds to the normal printing. An operation from pass 8 to pass 10 corresponds to the lower end printing (upon forming an image at the lower end portion of the medium).

In summary, in the lower end printing according to this embodiment, the color image is printed by the nozzles different from the nozzles (#1 to #12) of the color nozzle row Co printing the color image in the normal printing. More specifically, the nozzles printing the color image in the lower end printing according to this embodiment are set to be the nozzles located on the upstream side in the transport direction relative to the nozzles printing the color image in the normal printing.

As a consequence, in the comparative example (see FIG. 7B), the position of the raster line formed by the nozzle #12 of the head 41 at final pass X is the printing end position. In this embodiment, however, the position of the raster line formed by the nozzle #20 of the head 41 at final pass 10 is the printing end position (indicated by the heavy line), as shown in FIG. 10. Accordingly, in this embodiment, since the printing end position can be located on the upstream side in the transport direction, it is possible to shorten the position control range of the medium S in comparison to the comparative example. As a consequence, it is possible to decrease the blank space of the medium S. Specifically, in the comparative example, the sum of the protruding portion D of the lower end portion of the medium from the head 41 upon ending the printing and the distance corresponding to twelve nozzles is the blank space. In this embodiment, however, the sum of the protruding portion D of the upper end portion of the medium from the head 41 upon ending the printing and the distance corresponding to four nozzles is the blank space.

In a printer in which the discharging position of the medium S is variable, the printing end position can be located on the upstream side in the transport direction relative to the head 41 in the lower end printing according to this embodiment. Therefore, the printing can be ended at the discharging position shown in FIG. 8A. In this embodiment, from this fact, it can be known that the position control range of the medium S is shortened in comparison to the comparative example (see FIG. 8B).

In the comparative example, since the half (#13 to #24) of the nozzles of the color nozzle row Co on the upstream side in the transport direction are not used, the ink of the nozzles on the upstream side thickens. Therefore, ejection failure may occur. In this embodiment, however, since the nozzles of the color nozzle row Co on the upstream side in the transport direction are also used, the ejection failure can be prevented. Moreover, in this embodiment, not only the nozzles of the color nozzle row Co on the downstream side but also the nozzles thereof on the upstream side are used to use numerous nozzles. Therefore, it is possible to reduce differences in the characteristics of the nozzles.

That is, in the 5-color printing mode according to this embodiment and the normal printing, the nozzles printing the background image are set to be the nozzles on the upstream side in the transport direction, and the nozzles printing the color image are set to be the nozzles on the downstream side in the transport direction. In the upper end printing and the lower end printing, however, the nozzles printing the background image are different from the nozzles printing the color image. In the upper end printing, unlike the normal printing, the nozzles printing the background image are set to be the nozzles on the downstream side in the transport direction, and the printing start position is located on the downstream side in the transport direction. In the lower end printing, unlike the normal printing, the nozzles printing the color image are set to be the nozzles on the upstream side in the transport direction, and the printing end position is located on the upstream side in the transport direction. As a consequence, since the position control range of the medium can be shortened, the transport error rarely occurs or the blank space can be decreased. Since not only some of the nozzles but also the more numerous nozzles are used, it is possible to prevent the ink from thickening or reduce differences in the characteristics of the nozzles.

In the upper end printing, as shown in FIG. 9, the ejectable nozzles of the white nozzle row W are deviated to the upstream side in the transport direction, as the printing is executed. Specifically, on pass 1, the nozzles #1 to #8 of the white nozzle row W are ejectable nozzles. On pass 2, the nozzles #5 to #16 of the white nozzle row W are ejectable nozzles. Finally (after pass 3), the nozzles #13 to #24 which are the half of the white nozzle row W on the upstream side in the transport direction are ejectable nozzles. In the upper end printing, the ejectable nozzles of the color nozzle row Co are also expanded to the upstream side in the transport direction, as the ejectable nozzles of the white nozzle row W are changed to the nozzles on the upstream side in the transport direction. In this way, since the upper end printing can be changed to the normal printing, the color image printed on the next pass can be printed on the background image printed on the previous pass.

In the upper end printing according to this embodiment, by gradually delaying the ejectable nozzles of the white nozzle row W to the upstream side in the transport direction, the time, in which the background image is printed and then the color image is printed on the background image, is made equal to that of the normal printing. In the normal printing, the background image is printed on the previous pass and the color image is printed on the background image on the next pass.

For example, on pass 1, the nozzles until the nozzle #8 are set to be the ejectable nozzles. However, the background image may be printed on pass 1 by the nozzles (#9 to #24) on the downstream side of the nozzle #8. However, when the nozzles of the downstream side subsequent to the nozzle #9 also print the background image on pass 1, it is not necessary for the nozzles #5 to #16 to print the background image on pass 2. Therefore, the color image is printed on the background image, which is printed by the nozzles subsequent to the nozzle #9 on pass 1, on pass 3 in the normal printing. In this case, since the background image is printed and then the color image is printed after one pass, the time, in which the background image is printed and then the color image is printed, in the upper end printing may be different from that of the normal printing. Therefore, when a time gap occurs between the printing of the background image and the printing of the color image, a drying time of the background image becomes different and thus a dry state (a state where the color image soaks) of the background image may become different. For this reason, image concentration may become irregular. In this embodiment, however, the time, in which the background image is printed and then the color image is printed, is made uniform.

Accordingly, it is preferable to execute the upper end printing similar to the normal printing. In the normal printing, there are repeated an operation of ejecting ink droplets from the twelve nozzles (#13 to #24) of the white nozzle row W and an operation of transporting the medium S by a distance corresponding to the twelve nozzles. That is, as for the positional relation between the ejectable nozzles (#13 to #24) and the medium, the ejectable nozzles are deviated in the transport direction by a distance corresponding to twelve nozzles relative to the medium at each pass. In the upper end printing, the transport distance of the medium S after pass 1 is set to a distance corresponding to four nozzles, and the ejectable nozzle (for example, #16) on pass 2 is displaced by a distance corresponding to eight nozzles from the ejectable nozzle (for example, #8) on pass 1. Similarly, the transport distance of the medium S after pass 2 is set to a distance corresponding to four nozzles, and the ejectable nozzle (for example, #24) on pass 3 is displaced by a distance corresponding to eight nozzles from the ejectable nozzle (for example, #16) on pass 2. By doing so, as for the positional relation between the ejectable nozzles and the medium in the upper end printing, the ejectable nozzles are also deviated in the transport direction by the distance corresponding to twelve nozzles relative to the medium at each pass, as in the normal printing. That is, the sum of the deviation degree of an ejectable nozzle (a first nozzle printing a first image) to the upstream side in the transport direction at each pass in the upper end printing and the transport distance of the medium S in the upper end printing is set to be equal to the transport distance of the medium S in the normal printing. In this embodiment, by equalizing the deviation degree of the ejectable nozzles to the upstream side in the transport direction in the upper end printing, it is possible to equally use the nozzles of the white nozzle row W on the downstream side in the transport direction. Moreover, by equalizing the deviation degree of the ejectable nozzles to the upstream side in the transport direction in the upper end printing, the transport distance of the medium S can be uniform. As a consequence, since the transport operation can be stabilized, the printing can be easily controlled.

Similarly, in the lower end printing, as shown in FIG. 10, the ejectable nozzles of the color nozzle row Co are changed to the upstream side in the transport direction, as the printing is executed. Specifically, on pass 8, the nozzles #1 to #12 of the color nozzle row Co are ejectable nozzles. On pass 9, the nozzles #9 to #20 of the color nozzle row Co are ejectable nozzles. On pass 10, the nozzles #17 to #24 of the color nozzle row Co are ejectable nozzles. In the lower end printing, the ejectable nozzles of the white nozzle row W are also reduced to the upstream side in the transport direction, as the ejectable nozzles of the color nozzle row Co are changed to the nozzles on the upstream side in the transport direction. In this way, since the normal printing can be changed to the lower end printing, the color image printed on the next pass can be printed on the background image printed on the previous pass.

In the lower end printing, the sum of the deviation degree of an ejectable nozzle to the upstream side in the transport direction and the transport distance of the medium S is also set to be equal to the transport distance of the medium S in the normal printing. For example, the transport distance of the medium S after pass 8 is set to a distance corresponding to four nozzles, and the ejectable nozzle (for example, #20) on pass 9 is displaced by eight nozzles from the ejectable nozzle (for example, #12) on pass 8. By doing so, as for the positional relation between the ejectable nozzles and the medium in the lower end printing, the ejectable nozzles are also deviated in the transport direction by the distance corresponding to twelve nozzles relative to the medium at each pass. In this way, as in the lower end printing and the normal printing, the color image can be printed at the pass subsequent to the pass at which the background image is printed. As a consequence, since the time, in which the background image is printed and then the color image is printed, can be made uniform in the normal printing and the lower end printing, it is possible to prevent the image concentration from being irregular. By equalizing the deviation degree of the ejectable nozzles to the upstream side in the transport direction in the lower end printing, it is possible to equally use the nozzles of the color nozzle row Co on the upstream side in the transport direction. Moreover, by equalizing the deviation degree of the ejectable nozzles to the upstream side in the transport direction in the lower end printing, the transport distance of the medium S can be uniform. As a consequence, since the transport operation can be stabilized, the printing can be easily controlled.

However, the invention is not limited to the method of setting the sum of the deviation degree of an ejectable nozzle to the upstream side in the transport direction and the transport distance of the medium S in the upper end printing (or the lower end printing) to be equal to the transport distance of the medium S. For example, by making the time, in which the background image is printed and then the color image is printed, in the upper end printing (or the lower end printing) equal to that in the normal printing, it is possible to prevent the image concentration from being irregular.

Overlap Printing

Next, the upper end printing and the lower end printing will be described when an "overlap printing" is executed in the 5-color printing mode (which is a mode where a color image is printed on a background image of white ink). The "overlap printing" refers to a printing method of forming one raster line (a dot row in a movement direction) by a plurality of nozzles. According to the overlap printing, a difference in the characteristics of the nozzles can be reduced even when there is a nozzle causing ejection failure or a nozzle from which ink is ejected in a curved manner due to manufacturing error. This is because one raster line is formed by a plurality of nozzles. As a consequence, it is possible to prevent deterioration in image quality. In the following description, the overlap printing of forming one raster line using two nozzles will be described as an example. Raster lines are printed so as to be arranged in the transport direction at an interval narrower than the nozzle pitch d. Even though the overlap printing is not described in detail in the 4-color printing mode (which is a mode where a color image is printed directly on a medium), the overlap printing is executed using the entire color nozzle row Co.

5-Color Printing Mode According to Comparative Example

Figure 11:
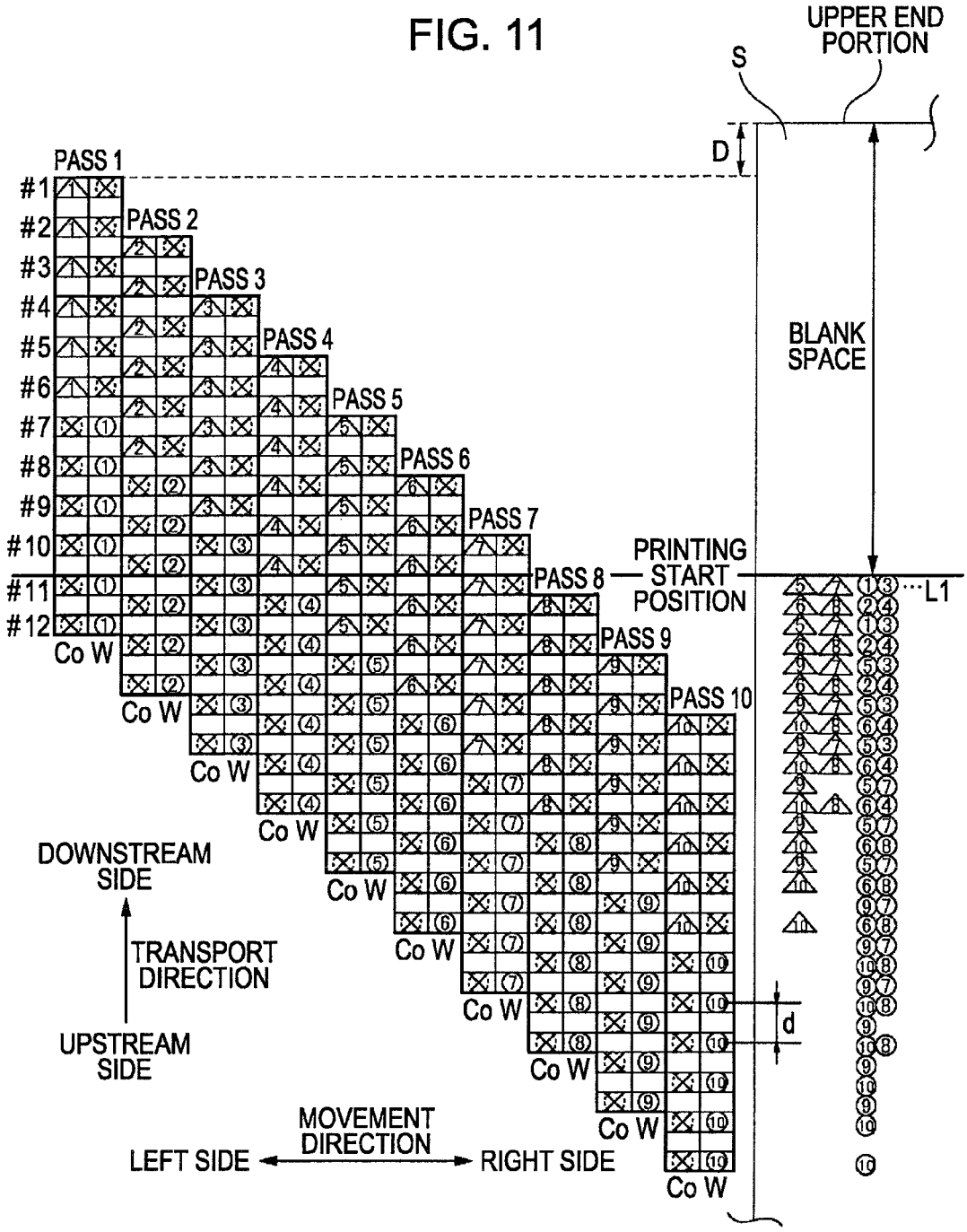
FIG. 11 is a diagram illustrating printing of the upper end portion of the medium in overlap printing in the 5-color printing mode according to a comparative example.
Figure 12:
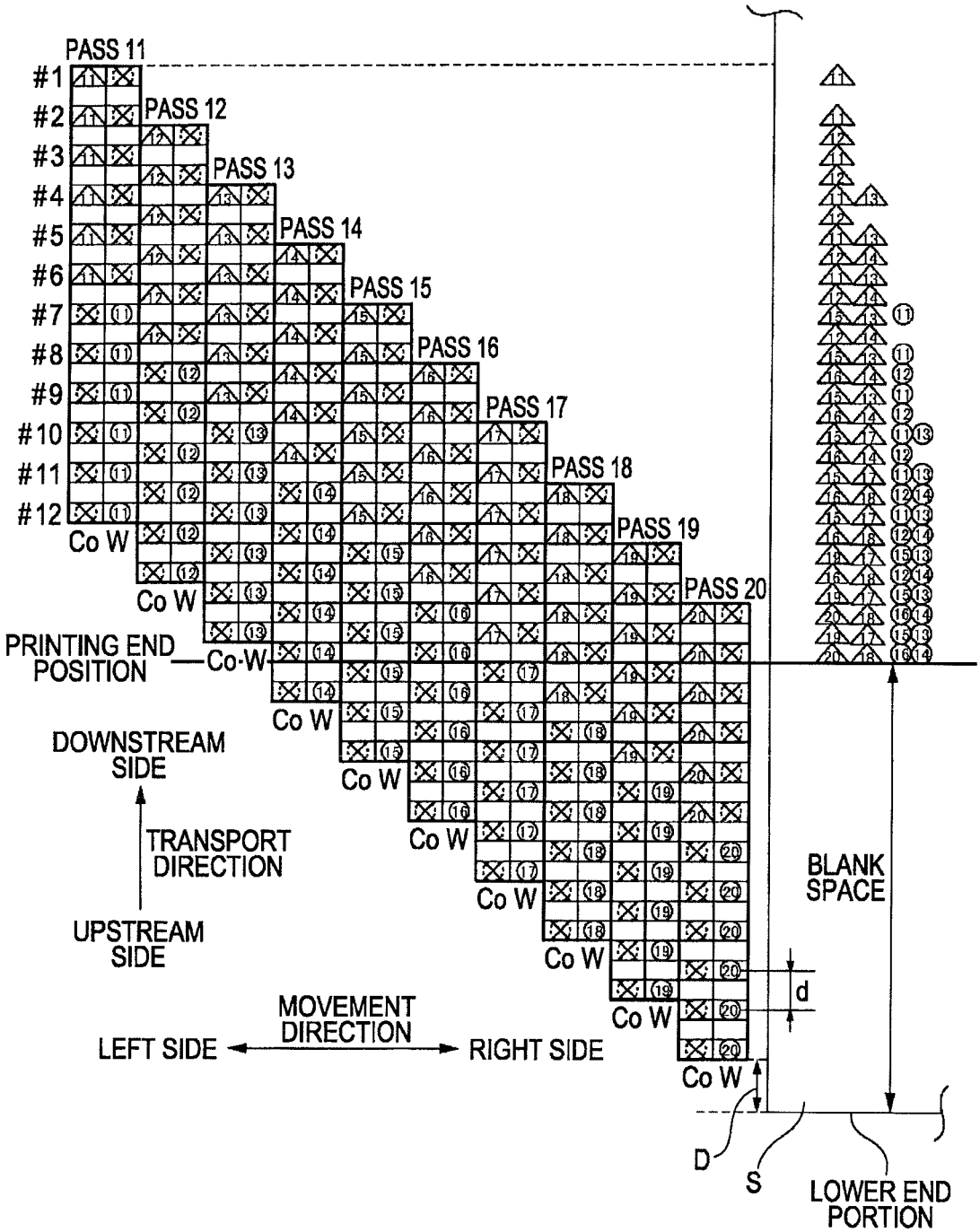
FIG. 12 is a diagram illustrating printing of the lower end portion of the medium in the overlap printing in the 5-color printing mode according to the comparative example.

FIG. 11 is a diagram illustrating printing of the upper end portion of the medium S in the overlap printing in the 5-color printing mode according to a comparative example. FIG. 12 is a diagram illustrating printing of the lower end portion of the medium S in the overlap printing in the 5-color printing mode according to the comparative example. For simple description, the number of nozzles is reduced to twelve (#1 to #12). The nozzles belonging to the color nozzle row Co (=YMCK) and dots of the color ink are indicated by triangles. The nozzles belonging to the white nozzle row W and dots of the white ink are indicated by circles. Numerals added in the circles and the triangles indicating the nozzles or the dots are pass numbers.

As described above, in the 5-color printing mode according to the comparative example, the nozzles printing a background image are set to the half (#7 to #12) of the nozzles of the white nozzle row W, and the nozzles printing a color image are set to the half (#1 to #6) of the nozzles of the color nozzle row Co. It is assumed that no ink is ejected from the half (#1 to #6) of the white nozzle row W on the downstream side in the transport direction and the half (#7 to #12) of the nozzles of the color nozzle row Co on the upstream side in the transport direction.

Next, a specific printing method (a method of printing the upper end portion of the medium S) will be described. In the comparative example, the transport distance of the medium S is "1.5 d (=3 mass), which is one and half time the nozzle pitch d (=2 mass). As shown in FIG. 11, upon starting the printing, the upper end portion of the medium S is located on the downstream side in the transport direction only by a distance D relative to the end of the head 41 (on pass 1) on the downstream side in the transport direction. Since the heavy line in FIG. 11 is the printing start position, the background image is printed on pass 1 by the two nozzles #11 and #12 of the white nozzle row W on the upstream side in the transport direction. On pass 1, no ink is ejected from the color nozzle row Co. Subsequently, the medium S is transported only by 1.5 d (3 mass).

On pass 2, the background image is printed by the three nozzles #10 to #12 of the white nozzle row W. On pass 3, the background image is printed by the five nozzles #8 to #12 of the white nozzle row W. On pass 4, the background image is printed by the six nozzles #7 to #12 of the white nozzle row W. Subsequently, on pass 5, an image is printed by the two nozzles #5 and #6 of the color nozzle row Co and the six nozzles #7 to #12 of the white nozzle row W. On pass 6, the image is printed by the three nozzles #4 to #6 of the color nozzle row Co and the six nozzles #7 to #12 of the white nozzle row W. On pass 7, the image is printed by the five nozzles #2 to #6 of the color nozzle row Co and the six nozzles #7 to #12 of the white nozzle row W.

On the next passes, there are alternately repeated an operation of forming an image by the half (#1 to #6) of the nozzles of the color nozzle row Co on the upstream side in the transport direction and the half (#7 to #12) of the nozzles of the white nozzle row W downstream side in the transport direction and an operation of transporting the medium S only by 1.5 d.

As a consequence, the color image can be printed on the background image on the next pass. As shown on the right side of FIG. 11, one raster line is formed by dots of two nozzles of the white nozzle row W and dots of two nozzles of the color nozzle row Co. For example, in raster line L1 on the lowermost downstream side (upper end side) in the transport direction, the background image is printed on pass 1 and pass 3, and then the color image is printed on pass 5 and pass 7 after pass 1 and pass 3.

In the overlap printing of the 5-color printing mode according to the comparative example, as shown in FIG. 11, the position of the raster line formed by the nozzle #11 of the white nozzle row W becomes the printing start position in a state where the upper end portion of the medium S exceeds the head 41 by the distance D upon starting the printing. That is, the printing start position is located on the upstream side in the transport direction relative to the head 41. Therefore, the position control range of the medium S is long and the blank space of the medium S is large. In the comparative example, since no ink droplets are ejected from the nozzles (#1 to #6) of the white nozzle row W on the downstream side in the transport direction, the ink may thicken and thus ejection failure may occur.

Next, a method of printing the lower end portion of the medium S will be described with reference to FIG. 12. Here, pass 20 is the final pass. Until pass 13, there are alternately repeated an operation of forming an image by the half (#1 to #6) of the nozzles of the color nozzle row Co on the downstream side and the half (#7 to #12) of the nozzles of the white nozzle row W on the upstream side and an operation of transporting the medium S only by 1.5 d. After pass 14, the number of nozzles ejecting the ink droplets becomes smaller.

On pass 14, the image is printed by the six nozzles #1 to #6 of the color nozzle row Co and the five nozzles #7 to #11 of the white nozzle row W. On pass 15, the image is printed by the six nozzles #1 to #6 of the color nozzle row Co and the three nozzles #7 to #9 of the white nozzle row W. On pass 16, the image is printed by the six nozzles #1 to #6 of the color nozzle row Co and the two nozzles #7 and #8 of the white nozzle row W. Subsequently, on pass 17, the color image is printed by the six nozzles #1 to #6 of the color nozzle row Co. On pass 18, the color image is printed by the five nozzles #1 to #5 of the color nozzle row Co. On pass 19, the color image is printed by the three nozzles #1 to #3 of the color nozzle row Co. On pass 20, the color image is printed by the two nozzles #1 and #2 of the color nozzle row Co. Then, the printing ends.

In the printing of the lower end portion according to the comparative example, as shown in FIG. 12, the position of the raster line formed by the nozzle #2 of the color nozzle row Co becomes the printing end position in a state where the lower end portion of the medium S exceeds the head 41 by the distance D upon ending the printing. That is, the printing end position is located on the downstream side in the transport direction relative to the head 41. Therefore, the position control range of the medium S is long and the blank space of the medium S is large. In the comparative example, since no ink droplets are ejected from the nozzles (#7 to #12) of the color nozzle row Co on the upstream side in the transport direction, the ink may thicken and thus ejection failure may occur.

For this reason, in the overlap printing of the 5-color printing mode according to the comparative example, it is necessary to shorten the position control range of the medium S as much as possible.

5-Color Printing Mode According to Embodiment

Figure 13:
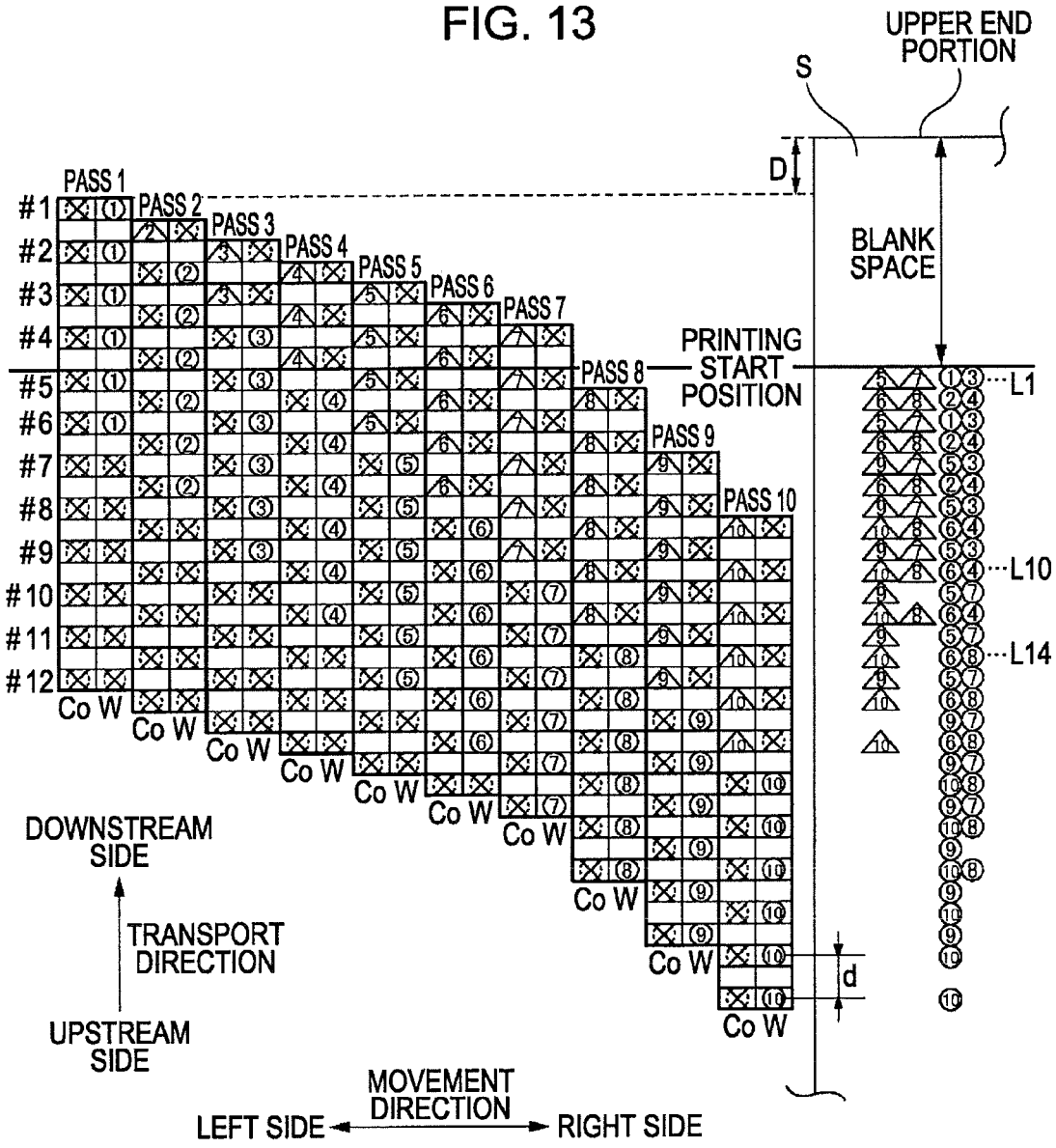
FIG. 13 is a diagram illustrating printing of the upper end portion of the medium in the overlap printing in the 5-color printing mode according to the embodiment.
Figure 14:
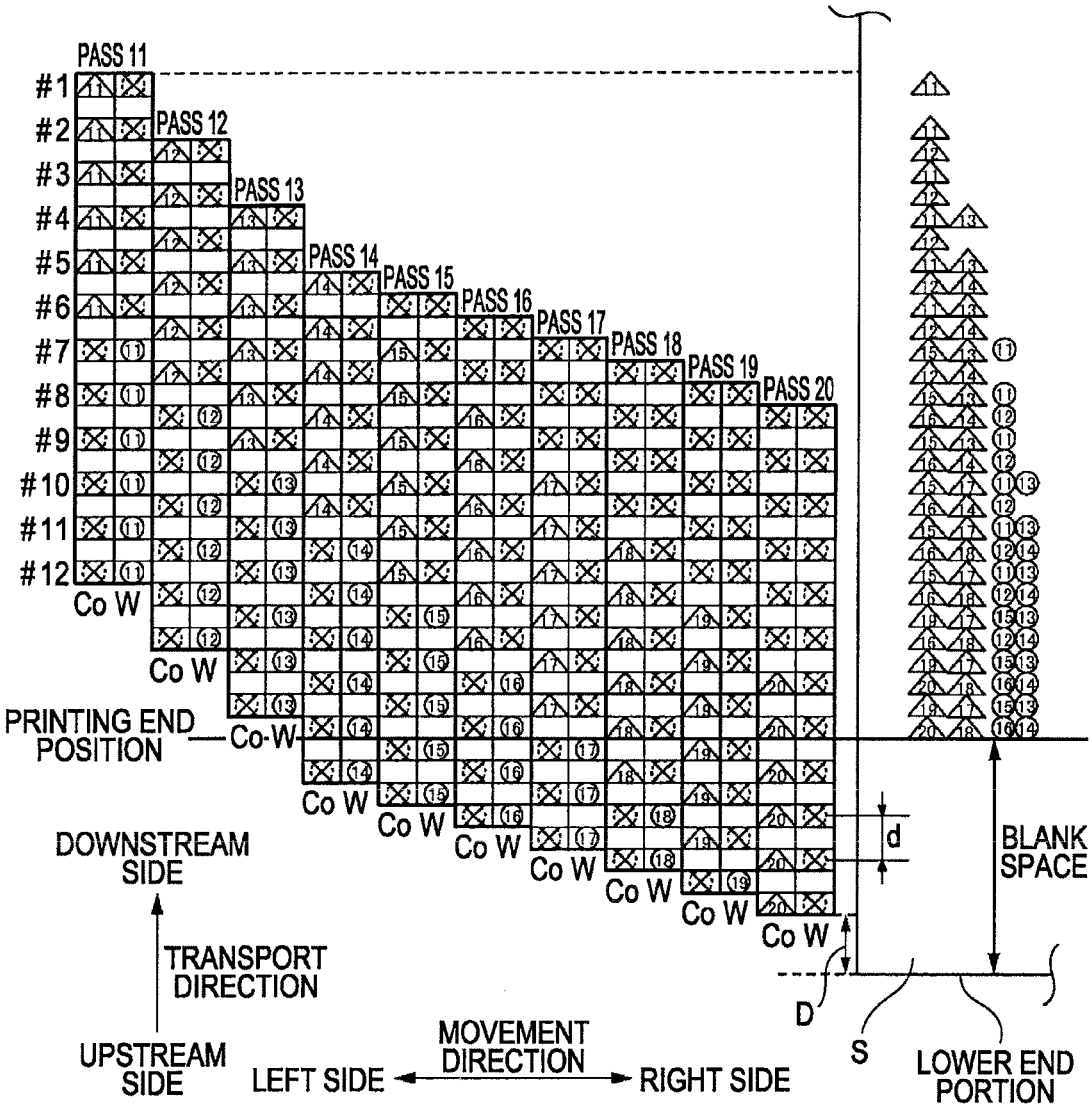
FIG. 14 is a diagram illustrating printing of the lower end portion of the medium in the overlap printing in the 5-color printing mode according to the embodiment.

FIG. 13 is a diagram illustrating printing of the upper end portion of the medium S in the overlap printing in the 5-color printing mode according to the embodiment. FIG. 14 is a diagram illustrating printing of the lower end portion of the medium S in the overlap printing in the 5-color printing mode according to the embodiment. In this embodiment, as in the above-described band printing, in order to shorten the position control range of the medium S as much as possible, the background image is printed using the nozzles of the white nozzle row W on the downstream side in the transport direction without fixing the nozzles of the white nozzle row W printing the background image to the half of the nozzles thereof on the upstream side in the transport direction. Moreover, the color image is printed also using the nozzles of the color nozzle row Co on the upstream side in the transport direction without fixing the nozzles of the color nozzle row Co printing the color image to the nozzles thereof on the downstream side in the transport direction.

First, the printing of the upper end portion of the medium S will be described in detail with reference to FIG. 13. The feeding position upon starting the printing is a position at which the upper end portion of the medium S is deviated to the downstream side in the transport direction only by the distance D relative to the end of the head 41 on the downstream side in the transport direction on pass 1. On pass 1, the six nozzles (#1 to #6) of the white nozzle row W from the lowermost downstream side in the transport direction are set to be the ejectable nozzles. However, since the position of the raster line formed by the nozzle #5 of the head 41 on pass 1 is the printing start position (indicated by a heavy line), as shown in FIG. 13, the background image is printed on pass 1 by the two nozzles #5 and #6 of the white nozzle row W. On pass 1, no ink droplets are ejected from the color nozzle row Co. Subsequently, the medium S is transported by a distance 0.5 d (=1 mass) which is the half of the nozzle pitch d.

Subsequently, on pass 2, the nozzles #2 to #7 of the white nozzle row W and the nozzle #1 of the color nozzle row Co are set to be the ejectable nozzles, but the ink droplets are ejected from the three nozzles #5 to #7 of the white nozzle row W. Subsequently, the medium S is transported only a half nozzle pitch 0.5 d. In the overlap printing according to this embodiment, the ejectable nozzles of the white nozzle row W and the color nozzle row Co are displaced to the upstream side in the transport direction by one nozzle at each pass. However, among the ejectable nozzles, the ink droplets are ejected from the nozzles located on the upstream side in the transport direction from the printing start position (indicated by the heavy line) in the drawing.

On pass 3, the nozzles #3 to #8 of the white nozzle row W and the nozzles #1 and #2 of the color nozzle row Co are set to be the ejectable nozzles, but the ink droplets are ejected from the nozzles #4 to #8. On pass 4, the nozzles #4 to #9 of the white nozzle row W and the nozzles #1 to #3 of the color nozzle row Co are set to be the ejectable nozzles, but the ink droplets are ejected from the nozzles #4 to #9. On pass 5, the nozzles #5 to #10 of the white nozzle row W and the nozzles #1 to #4 of the color nozzle row Co are set to be the ejectable nozzles, but the ink droplets are ejected from the nozzles #3 to #10. On pass 6, the nozzles #6 to #11 of the white nozzle row W and the nozzles #1 to #5 of the color nozzle row Co are set to be the ejectable nozzles, but the ink droplets are ejected from the nozzles #3 to #11. On pass 7, the nozzles #7 to #12 of the white nozzle row W and the nozzles #1 to #6 of the color nozzle row Co are set to be the ejectable nozzles, but the ink droplets are ejected from the nozzles #2 to #12. From pass 1 to pass 7, the transport distance of the medium S is the half nozzle pitch 0.5 d.

As a consequence, the color image can be printed on the background image on the next passes. As shown in the right part of FIG. 13, one raster line is formed by dots of two nozzles of the white nozzle row W and dots of two nozzles of the color nozzle row Co.

Subsequently, (after pass 8), there are alternately repeated an operation of printing the color image by the half (#1 to #6) of the nozzles of the color nozzle row Co on the downstream side in the transport direction and the half (#7 to #12) of the nozzles of the white nozzle row W on the upstream side in the transport direction and an operation of transporting the medium S by a distance 1.5 d (=3 mass) which is one and half times the nozzle pitch. In this way, since the color image can be printed on the background image on the next pass, one raster line is formed by the dots of two nozzles of the white nozzle row W and the dots of two nozzles of the color nozzle row Co.

Here, as described above, at the pass at which the number of nozzles (the number of nozzles ejecting the ink) used or the nozzle position are different from those of the normal printing, the upper end printing is executed. When the transport distance of the medium after a given pass is different from that of the normal printing, the upper end printing is executed. Therefore, in FIG. 13, the operation from pass 1 to pass 7 (a transport operation after the pass 1 to pass 7) corresponds to the upper end printing. An operation after pass 8 corresponds to the normal printing (when forming a an image at the middle portion of the medium).

Even in the overlap printing, the background image is printed in the upper end printing by using the nozzles different from the nozzles (#7 to #12) printing the background image in the normal printing. More specifically, the nozzles printing the background image in the upper end printing are not set to be the nozzles printing the background image in the normal printing, but are set to be the nozzles located on the downstream side in the transport direction.

As a consequence, in the comparative example (see FIG. 11), the position of the raster line formed by the nozzle #11 of the head 41 on pass 1 is the printing start position. In this embodiment, however, as shown in FIG. 13, the position of the raster line formed by the nozzle #5 of the head 41 on pass 1 is the printing start position (indicated by the heavy line). Therefore, in this embodiment, since the printing start position can be located on the downstream side in the transport direction in comparison to the comparative example, it is possible to shorten the position control range of the medium S. Therefore, the blank space of the medium S can be made small.

In the upper end printing, the ejectable nozzles of the white nozzle row W are deviated on the upstream side in the transport direction, as the printing is executed. In the upper end printing, the number of the ejectable nozzles of the color nozzle row Co is increased to the upstream side in the transport direction, as the ejectable nozzles of the white nozzle row W are changed to the upstream side in the transport direction. In this way, since the upper end printing can be changed to the normal printing, the color image can be printed on the next pass on the background image printed on the previous pass.

In the comparative example, since the half (#1 to #6) of the nozzles of the white nozzle row W on the downstream side in the transport direction are not used in the printing, the ink of the nozzles on the downstream side may thicken and thus ejection failure may occur. In this embodiment, however, since the nozzles of the white nozzle row W on the downstream side in the transport direction are also used, the ejection failure can be prevented. Moreover, in this embodiment, not only the nozzles of the white nozzle row W on the upstream side but also the nozzles thereof on the downstream side are used to use numerous nozzles. Therefore, it is possible to reduce the differences in the characteristics of the nozzles.

In order to execute the methods of forming the dots in the normal printing and the upper end printing in the same manner, the sum of the deviation of the ejectable nozzles to the upstream side in the transport direction in the upper end printing and the transport distance of the medium S is set to be equal to the transport distance of the medium S in the normal printing. In the normal printing, as for the positional relation between the ejectable nozzles (#7 to #12) and the medium S, the ejectable nozzles are deviated in the transport direction by a distance corresponding to 1.5 nozzles (3 mass) each pass. In the upper end printing, the ejectable nozzles of the white nozzle row W are deviated by one nozzle to the upstream side in the transport direction, as the printing is executed. That is, in the upper end printing, the transport distance of the medium S is a distance corresponding to 0.5 nozzle (1 mass), the position of the ejectable nozzle is deviated by one nozzle (2 mass) to the upstream side in the transport direction at each pass. As a consequence, in the upper end printing, as in the normal printing, as for the positional relation between the ejectable nozzles and the medium S, the ejectable nozzles are also deviated in the transport direction by a distance corresponding to 1.5 nozzles (3 mass) each pass.

As shown in FIG. 13, the relative position of the nozzle on the uppermost upstream side among the ejectable nozzles of the white nozzle row W to the medium S is deviated by 3 mass (a distance corresponding to 1.5 nozzles) at each pass in either the upper end printing (pass 1 to pass 7) or the normal printing (after pass 8). For example, in FIG. 13, the nozzle #6 on the uppermost upstream side among the ejectable nozzles of the white nozzle row W on pass 1 in the upper end printing is deviated by 3 mass (the distance corresponding to 1.5 nozzles) from the nozzle #7 on the uppermost upstream side among the ejectable nozzles of the white nozzle row W on pass 2. Similarly, the nozzle #12 on the uppermost upstream side among the ejectable nozzles of the white nozzle row W on pass 8 in the normal printing is deviated by 3 mass (the distance corresponding to 1.5 nozzles) from the nozzle #12 on the uppermost upstream side among the ejectable nozzles of the white nozzle row W on pass 9.

As a consequence, the time, in which the background image is printed and the color image is printed on the background image, in the upper end printing can be made equal to that in the normal printing. For example, in the raster line L1 on the lowermost downstream side in the transport direction, as shown in the right part of FIG. 13, the background image is printed on pass 3 and then the color image is printed on pass 5. Therefore, the background image is printed and then the color image is printed after one-time pass. Similarly, in the tenth raster line L10, the background image is printed on pass 6 and then the color image is printed on pass 8. In the fourteenth raster line L14, the background image is printed on pass 8 and then the color image is printed on pass 10. Therefore, the background image is printed and then the color image is printed after one-time pass. In this way, since the time, in which the background image is printed and the color image is printed, in the upper end printing and the normal printing can be made uniform, it is possible to prevent the image concentration from being irregular.

In the upper end printing and the normal printing, the interval at which the background image is printed by two nozzles and the interval at which the color image is printed by two nozzles can be made uniform in one raster line. For example, in the raster line L1, the background image is formed on pass 1 and pass 3 (where an interval is one pass) and the color image is formed on pass 5 and pass 7 (where an interval is one pass). Similarly, in the raster line 10, the background image is formed on pass 4 and pass 6 (where an interval is one pass) and the color image is formed on pass 8 and pass 10 (where an interval is one pass). In this way, by executing the upper end printing and the normal printing in the same manner, it is possible to prevent the image from being irregular. Moreover, in the one raster line, the interval at which the background image is formed by two nozzles, the interval at which the background image is formed and then the color image is printed, and the interval at which the color image is formed by two nozzles are all uniform (where the intervals are all one pass).

In this embodiment, the deviation of the ejectable nozzles to the upstream side in the transport direction in the upper end printing can be made uniform. Therefore, the nozzles of the white nozzle row W can be equally used. Moreover, the deviation of the ejectable nozzles on the upstream side in the transport direction in the upper end printing can be made uniform. Therefore, the transport distance of the medium S becomes uniform. As a consequence, since the transport operation can be stabilized, the printing can be easily controlled.

Next, the lower end printing of the medium S will be described with reference to FIG. 14. Here, it is assumed that the printing ends on pass 20. The normal printing (when forming a an image at the middle portion of the medium) is executed until pass 13 (the transport operation after pass 13). There are alternately repeated an operation of printing the color image by the half (#1 to #6) of the nozzles of the color nozzle row Co on the downstream side in the transport direction and printing the background image by the half (#7 to #12) of the white nozzle row W on the upstream side in the transport direction and an operation of transporting the medium S only by 1.5 d. The passes from pass 14 to pass 20 correspond to image formation of the lower end portion of the medium.

On pass 14, the half (#1 to #6) of the nozzles of the color nozzle row Co on the downstream side in the transport direction and the half (#7 to #12) of the nozzles of the white nozzle row W on the upstream side in the transport direction are set to be the ejectable nozzles. However, as shown in FIG. 14, the position of the raster line formed by the nozzle #11 of the head 41 on pass 14 is the printing end position (indicated by a heavy line). Therefore, on pass 14, no ink droplets are ejected from the nozzle #12 of the white nozzle row W. After pass 14, the medium S is transported by a distance 0.5 d (1 mass) which is the half of the nozzle pitch d.

Subsequently, on pass 15, the nozzles #2 to #7 of the color nozzle row Co and the nozzles #8 to #12 of the white nozzle row W are set to be the ejectable nozzles, but no ink droplets are ejected from the nozzles #11 and #12 of the white nozzle row W. In this way, in the lower end printing, the number of ejectable nozzles of the white nozzle row W and the number of the ejectable nozzles of the color nozzle row Co are decreased by one nozzle at each pass to the upstream side in the transport direction. However, among the ejectable nozzles, no ink droplets are ejected from the nozzles located on the upstream side in the transport direction relative to the printing end position (which is indicated by the heavy line) in the drawing.

On pass 16, the nozzles #3 to #8 of the color nozzle row W and the nozzles #9 to #12 of the white nozzle row W are set to be the ejectable nozzles, but no ink droplets are ejected from the nozzles #11 and #12 of the white nozzle row W. On pass 17, the ink droplets are ejected from the nozzles #4 to #9 of the color nozzle row W. On pass 18, the ink droplets are ejected from the nozzles #5 to #9 of the color nozzle row W. On pass 19, the ink droplets are ejected from the nozzles #6 to #8 of the color nozzle row W. On pass 20, the ink droplets are ejected from the nozzles #7 and #8 of the color nozzle row W.

As a consequence, the color image can be printed on the background image on the next pass. As shown in the right part of FIG. 14, one raster line is formed by the dots of two nozzles of the white nozzle row W and the dots of two nozzles of the color nozzle row Co.

In this way, in the lower end printing, the color image is printed using the nozzles different from the nozzles (#1 to #6) printing the color image in the normal printing. More specifically, the nozzles printing the color image in the lower end printing are not set to be the nozzles printing the color image in the normal printing, but are set to be the nozzles located on the upstream side in the transport direction.

As a consequence, in the comparative example (see FIG. 12), the position of the raster line formed by the nozzle #2 of the head 41 on pass 20 is the printing end position. In this embodiment, however, as shown in FIG. 14, the position of the raster line formed by the nozzle #8 of the head 41 on pass 20 is the printing end position (indicated by the heavy line). Therefore, in this embodiment, since the printing end position can be located on the upstream side in the transport direction in comparison to the comparative example, it is possible to shorten the position control range of the medium S. Therefore, the blank space of the medium S can be made small.

In this embodiment, since the nozzles (#7 to #12) of the color nozzle row Co on the upstream side in the transport direction are also used, it is possible to prevent the ink from thickening (ejection failure). In this embodiment, not only the nozzles of the color nozzle row Co on the downstream side but also the nozzles thereof on the upstream side are used to use more numerous nozzles, it is possible to reduce differences in the characteristics of the nozzles.

In the lower end printing, the ejectable nozzles of the color nozzle row Co are deviated on the upstream side in the transport direction, as the printing is executed. In the lower end printing, the number of the ejectable nozzles of the white nozzle row W is decreased to the upstream side in the transport direction, as the ejectable nozzles of the color nozzle row Co are changed to the upstream side in the transport direction. In this way, since the normal printing can be changed to the lower end printing, the color image can be printed on the next pass on the background image printed on the previous pass.

In order to execute the methods of forming the dots in the lower end printing and the normal printing in the same manner, the sum of the deviation of the ejectable nozzles of the color nozzle row Co to the upstream side in the transport direction in the lower end printing and the transport distance of the medium S is set to be equal to the transport distance of the medium S in the normal printing. As for the positional relation between the ejectable nozzles (#1 to #6) of the color nozzle row Co and the medium S in the normal printing, the ejectable nozzles are deviated in the transport direction by the distance corresponding to 1.5 nozzles (3 mass) each pass. In the lower end printing, the transport distance of the medium S is set to be the distance corresponding to 0.5 nozzle (1 mass) and the position of the ejectable nozzle is displaced by the distance corresponding to one nozzle (2 mass) to the upstream side in the transport direction. In this way, since the time, in which the background image is printed and the color image is printed, in the normal printing and the lower end printing can be made uniform, it is possible to prevent the image concentration from being irregular. Moreover, in this embodiment, the deviation of the ejectable nozzles to the upstream side in the transport direction in the lower end printing can be made uniform. Therefore, the nozzles of the color nozzle row Co can be equally used. Moreover, the deviation of the ejectable nozzles on the upstream side in the transport direction in the lower end printing can be made uniform. Therefore, the transport distance of the medium S becomes uniform. As a consequence, since the transport operation can be stabilized, the printing can be easily controlled.

Other Embodiments

In the above-described embodiment, the printing system including the ink jet printer has mainly been described, but disclosure of the upper end printing is included. Although the above-described embodiment is to be considered as illustrative to understand the invention more easily, the invention is not limited thereto. The invention may be modified and improved without the gist of the invention. Of course, the equivalents of the invention are included in the invention. In particular, the following embodiments are included in the invention.

Lower End Printing

In the above-described embodiment, in the printing of the lower end portion (on the upstream side in the transport direction) of the medium, the nozzles printing the color image are also different from those of the normal printing (the nozzles of the color nozzle row Co on the upstream side in the transport direction are used), but the invention is not limited thereto. For example, in order to print the lower end portion of the medium, as in the normal printing, the color image may be printed by the nozzles (the set nozzles) of the color nozzles row Co on the downstream side in the transport direction.

Printing Product

In the above-described embodiment, the background image is printed with the white ink, and the color image is printed on the background image by the nozzle rows (YMCK) for the color ink to form a printing product (so-called front-surface printing), but the invention is not limited thereto. For example, the color image may be printed on a medium such as a transparent film, and the background image may be printed on the color image to form a printing product (so-called rear-surface printing). In the printing product, an image can be viewed from the opposite side of the printed surface of the medium. In this case, in the normal printing, the nozzles ejecting the ink from the white nozzle row W are not set to be the nozzles on the upstream side in the transport direction, but the nozzles ejecting the ink from the color nozzle row Co are set to be the nozzles on the upstream side in the transport direction. In the upper end printing, by using the nozzles of the color nozzle row Co on the downstream side in the transport direction, the printing start position is located on the more downstream side in the transport direction. The background image may be printed not only with the white ink but also with other color ink (for example, YMCK or metallic color).

The background image may be printed with the white ink on the medium, the color image may be printed on the background image, and the image may finally be coated with clear ink to form a printing product. In the normal printing, the background image may be printed by ⅓ of the nozzles of the white nozzle row W on the upstream side in the transport direction, the color image may be printed by the middle ⅓ of the nozzles of the color nozzle row Co, and the image may be coated by the ⅓ of the nozzles of a clear ink nozzle row on the downstream side in the transport direction. In the upper end printing, by the nozzles of the white nozzle row W on the downstream side in the transport direction, the printing start position is located on the more downstream side in the transport direction.

In the above-described embodiment, as shown in FIG. 3, the four nozzles rows ejecting the color ink (YMCK) are arranged in the movement direction, but the invention is not limited thereto. For example, two nozzle rows of the four nozzle rows may be arranged in the transport direction and two-color nozzle row groups may be arranged in the movement direction. The length of the white nozzle row W is set to a length corresponding to two-color nozzle rows. In this printer, in order to print the color image on the background image formed with white ink, for example, the half of the nozzles on the upstream side in the transport direction are used in the nozzle row of the two-color nozzle rows on the upstream side in the transport direction, and the half of the nozzles on the downstream side in the transport direction are used in the nozzle row thereof on the downstream side in the transport direction. The ¼ of the nozzles on the uppermost upstream side in the transport direction are used in the white nozzle row W. Even in this case, in the upper end printing, by using the nozzles of the white nozzle row W on the downstream side in the transport direction, the printing start position is located on the more downstream side in the transport direction.

Printing Method

In the above-described embodiment, the band printing and the overlap printing are exemplified, but the invention is not limited thereto. Another printing may be used (for example, a printing method of forming a plurality of raster lines at another pass between raster lines arranged in a nozzle pitch interval, as in interlace printing). In another printing method, not only the nozzles of the white nozzle row W printing the background image but also the nozzles of the white nozzle row W on the downstream side in the transport direction may be used in the upper end printing.

Background Image and Color Image

In the above-described embodiment, the background image is printed only with the white ink, but the invention is not limited thereto. By changing the color tinge of the background image, for example, by mixing color ink (such as cyan ink) to the white ink, the background image may be printed. That is, the ink may be ejected from the nozzles of the white nozzle row W and the color nozzle row Co located at the same positions at the same pass. For example, on pass 3 in FIG. 9, the nozzles printing the background image are set to be the nozzles #13 to #24 of the white nozzle row W and the nozzles #13 to #24 of the color nozzle row Co. The nozzles printing the color image are set to be the nozzles #1 to #12 of the color nozzle row Co.

On the contrary, in order to improve color reproducibility, a color image may be printed adding the white ink to the color ink (YMCK). For example, on pass 3 in FIG. 9, the nozzles printing the background image are set to be the nozzles #13 to #24 of the white nozzle row W. The nozzles printing the color image are set to be the nozzles #1 to #12 of the color nozzle row Co and the nozzles #1 to #12 of the white nozzle row W.

Liquid Ejecting Apparatus

In the above-described embodiment, the ink jet printer is used as the liquid ejecting apparatus, but the invention is not limited thereto. The invention is applicable to various industrial apparatuses other than a printer, as long as these apparatuses are the liquid ejecting apparatus. For example, the invention is applicable to a printing apparatus attaching shapes to a cloth, a display manufacturing apparatus such as a color filter manufacturing apparatus or an organic EL display apparatus, a DNA chip manufacturing apparatus manufacturing a DNA chip by applying a solution in which DNA is melted in a chip, or the like.

A liquid ejecting method may be a piezoelectric method of applying a voltage to driving elements (piezoelectric elements) and ejecting a liquid by expansion and contraction of ink chambers or a thermal method of generating bubbles in nozzles by use of heating elements and ejecting a liquid by the bubbles.

The ink ejected from the head 41 may be ultraviolet curing ink curing when ultraviolet is emitted. In this case, a head ejecting the ultraviolet curing ink and an emitter emitting ultraviolet to the ultraviolet curing ink may be mounted on the carriage 31. A powder may be ejected from the head.

The entire disclosure of Japanese Patent Application No. 2009-175736, filed Jul. 28, 2009 is expressly incorporated by reference herein.

What is claimed is:

1. A liquid ejecting method with a liquid ejecting apparatus having nozzles, a movement mechanism and a transport mechanism, the liquid ejecting method comprising:

(a) ejecting liquid from the nozzles in an image forming operation, in which the nozzles are moved in a movement direction relative to a medium by the movement mechanism;

(b) repeating the image forming operation and a transport operation, in which the medium is transported in a predetermined direction intersecting the movement direction relative to the nozzles by the transport mechanism, to form images at a middle portion of the medium and an upper end portion of the medium, wherein the images include a first image and a second image formed on the first image, the images being formed such that a portion of the first image is formed in a given image forming operation and a portion of the second image is formed in the given image forming operation on a portion of the first image formed in another image forming operation;

(c) differentiating between the nozzles ejecting the liquid to form the first image at the middle portion and the nozzles ejecting the liquid to form the first image at the upper end portion, wherein the nozzles ejecting the liquid to form the first image in a given image forming operation are located on an upstream side in the predetermined direction relative to the nozzles ejecting the liquid to form the second image in the given image forming operation, and wherein the nozzles ejecting the liquid to form the first image at the middle portion include one or more nozzles which are located at an upstream side in the predetermined direction relative to the nozzles ejecting the liquid to form the first image at the upper end portion; and (d) performing the transport operation between forming the first image at the upper end portion and forming the first image at the middle portion.

2. The liquid ejecting method according to claim 1, wherein the first image is formed by a white pink.

3. The liquid ejecting method according to claim 2, wherein the second image is formed by a color ink.

4. The liquid ejecting method according to claim 1, further comprising changing a transport distance of the transport operation based on a number of nozzles which eject the liquid in the image forming operation.

5. The liquid ejecting method according to claim 1, wherein the first image is formed by a color ink.

6. The liquid ejecting method according to claim 5, wherein the second image is formed by a white ink.

* * * * *